US010923301B2

(12) United States Patent
Esther et al.

(10) Patent No.: US 10,923,301 B2
(45) Date of Patent: Feb. 16, 2021

(54) DOUBLE THROW SWITCH OPERATING MECHANISM

(71) Applicant: The Durham Co., Lebanon, MO (US)

(72) Inventors: Cameron Alan Esther, Lebanon, MO (US); Kevin Lee Moore, Lebanon, MO (US); Kevin Duane Wade, Lebanon, MO (US)

(73) Assignee: The Durham Company, Lebanon, MO (US)

( * ) Notice: Subject to any disclaimer, the term of this patent is extended or adjusted under 35 U.S.C. 154(b) by 0 days.

(21) Appl. No.: 16/182,394

(22) Filed: Nov. 6, 2018

(65) Prior Publication Data

US 2019/0139725 A1 May 9, 2019

Related U.S. Application Data

(60) Provisional application No. 62/582,469, filed on Nov. 7, 2017.

(51) Int. Cl.

| | |
|---|---|
| ***H01H 21/42*** | (2006.01) |
| ***H01H 21/36*** | (2006.01) |
| ***H01H 21/60*** | (2006.01) |
| ***H01H 21/30*** | (2006.01) |
| ***H01H 1/20*** | (2006.01) |
| *H01H 21/06* | (2006.01) |

(52) U.S. Cl.

CPC ..... *H01H 21/36* (2013.01); *H01H 1/2041* (2013.01); *H01H 21/30* (2013.01); *H01H 21/60* (2013.01); *H01H 21/06* (2013.01); *H01H 2221/072* (2013.01); *H01H 2221/088* (2013.01); *H01H 2225/01* (2013.01)

(58) Field of Classification Search

CPC ..... H01H 21/54; H01H 21/38; H01H 21/60; H01H 21/52; H01H 2021/225; H01H 1/205; H01H 3/04; H01H 3/06; H01H 3/227; H01H 3/48; H01H 2009/0088; H01H 2009/0094; H01H 21/42; H01H 21/30; H01H 21/06; H01H 21/40

See application file for complete search history.

(56) References Cited

U.S. PATENT DOCUMENTS 1,785,192 A * 12/1930 Hammerly ..... H01H 21/42 200/446
2,379,130 A * 6/1945 Cole ..... H01H 21/42 200/18
4,778,959 A * 10/1988 Sabatella ..... H01H 21/16 200/453

(Continued)

*Primary Examiner* — Felix O Figueroa

(57) ABSTRACT

A switching mechanism includes an actuator rotatable between an off position and an on position; and a timing disc assembly that includes an actuator disc, a bias disc, and a switch disc arranged in a stack. The actuator disc is rotatably connected to the actuator. The bias disc is connected to at least one biasing mechanism. The switch disc is connected to a switch. The actuator disc is configured to engage the bias disc such that the actuator disc is configured to rotate the bias disc to an overcenter position of the at least one biasing mechanism. The overcenter position of the at least one biasing mechanism is configured to rotate the bias disc such that engagement between the bias disc and the switch disc is configured to rotate the switch disc between a closed position and an open position of the switch.

20 Claims, 25 Drawing Sheets

(56) References Cited

U.S. PATENT DOCUMENTS

| | | | | |
|---|---|---|---|---|
| 4,902,864 | A * | 2/1990 | Markowski | H01H 21/42 200/329 |
| 4,999,598 | A * | 3/1991 | Jannesari | H01H 3/42 200/18 |
| 6,940,032 | B2 * | 9/2005 | Sirajtheen | H01H 5/06 200/400 |
| 8,987,622 | B2 * | 3/2015 | Ando | H01H 3/44 200/401 |

* cited by examiner

DOUBLE THROW SWITCH OPERATING MECHANISM

CROSS-REFERENCE TO RELATED APPLICATION

This Application claims priority to and the benefit of U.S. Provisional Patent Application Ser. No. 62/582,469, filed on Nov. 7, 2017, which is incorporated herein by reference in its entirety.

BACKGROUND

Switches having a single open circuit (off) position and two separate closed circuit (on) positions are useful in many power management scenarios. Some such scenarios require switching between two alternative power sources to provide electricity to a common load (e.g., switching between a municipal electricity grid and an auxiliary power source to provide electrical power to a given site). Other such scenarios require switching between two alternative loads and a single common power source (e.g.: switching between two separate sets of assembly line equipment and a single common power source at a manufacturing plant).

Some contemporary switch solutions providing a single open circuit (off) position and two alternative closed circuit (on) positions for industrial power management use two separate single throw switches, each having a single open circuit (off) position and a single closed circuit (on) position, configured to operate in opposite directions. Each such single throw switch requires a separate operating mechanism connected to a common handle through a linkage apparatus controlling which source or load is in use. Other contemporary switch solutions use two single throw switches in combination with a series of linkages and slider plates connected to a common actuator. Such contemporary switches require many component moving parts and are mechanically complex, and as a result are expensive to produce, repair, and maintain.

SUMMARY

Some examples provide a switching mechanism for actuating a switch. The switching mechanism includes an actuator rotatable between an off position and an on position; and a timing disc assembly. The timing disc assembly includes an actuator disc, a bias disc, and a switch disc arranged in a stack such that the actuator disc, the bias disc, and the switch disc overlay each other. The actuator disc is rotatably connected to the actuator such that the actuator disc is configured to rotate with the actuator. The bias disc is connected to at least one biasing mechanism. The switch disc is connected to the switch. The actuator disc is configured to engage the bias disc such that the actuator disc is configured to rotate the bias disc to an overcenter position of the at least one biasing mechanism. The overcenter position of the at least one biasing mechanism is configured to rotate the bias disc such that engagement between the bias disc and the switch disc is configured to rotate the switch disc between a closed position and an open position of the switch.

Other examples provide a switch assembly. The switch assembly includes a switch having an open position and a closed position. The switch assembly also includes a switching mechanism operatively connected to the switch for actuating the switch between the open position and the closed position. The switching mechanism includes an actuator rotatable between an off position wherein the switch is in the open position and an on position wherein the switch is in the closed position. The switching mechanism also includes a timing disc assembly. The timing disc assembly includes an actuator disc, a bias disc, and a switch disc arranged in a stack such that the actuator disc, the bias disc, and the switch disc overlay each other. The actuator disc is rotatably connected to the actuator such that the actuator disc is configured to rotate with the actuator. The bias disc is connected to at least one biasing mechanism. The switch disc is connected to the switch. The actuator disc is configured to engage the bias disc such that the actuator disc is configured to rotate the bias disc to an overcenter position of the at least one biasing mechanism. The overcenter position of the at least one biasing mechanism is configured to rotate the bias disc such that engagement between the bias disc and the switch disc is configured to rotate the switch disc between the open position and the closed position of the switch.

Still other examples provide a switch assembly. The switch assembly includes a switch having a first set of electrical contacts and a second set of electrical contacts. The switch has an off position wherein the first set of electrical contacts is open and the second set of electrical contacts is open. The switch also has a first closed position wherein the first set of electrical contacts is closed and the second set of electrical contacts is open. The switch further has a second closed position wherein the first set of electrical contacts is open and the second set of electrical contacts is closed. The switch assembly further includes a switching mechanism operatively connected to the switch for actuating the switch between the open position and the first closed position and the second closed position. The switching mechanism includes an actuator and a timing disc assembly. The timing disc assembly includes an actuator disc and a switch disc arranged in a stack such that the actuator disc and the switch disc overlay each other. The actuator disc is rotatably connected to the actuator such that the actuator disc is configured to rotate with the actuator. The switch disc is connected to the switch. The actuator disc is configured to rotate the switch disc such that the switch disc moves the switch between the open position and the first closed position and the second closed position of the switch.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

Corresponding reference characters indicate corresponding parts throughout the drawings.

DETAILED DESCRIPTION

Referring to the figures, examples of the disclosure provide a disc-based mechanism configured to operate a double throw switch with a single actuator. Examples of the disclosure operate without requiring any complex linkage apparatuses and/or slider plates connected to a common actuator. Depending on the configuration of the mechanism, a single actuator (e.g.: a single handle) controls which source or load is in use. The disclosure uses fewer components and is mechanically simpler than contemporary switches, and is therefore less expensive to produce, repair, and maintain.

The elements described herein operate in an unconventional manner to allow for operation of a double throw switch using a single mechanism. The disclosed mechanism improves the function of systems incorporating a double throw switch by, in a non-limiting example: (1) enabling a user to actuate the switch from the open position to either of the closed positions by manipulating a single actuator (as opposed to one actuator for each closed position); (2) in certain configurations, taking up considerably less physical space than contemporary switches using a combination of two single throw switches, linkages, and/or slider plates, thus increasing the available space for equipment utilizing the electricity delivered by the double throw switch, thereby potentially increasing efficiency of operations; and (3) extending the operational lifetime and time between routine maintenance and repairs by utilizing a mechanically simpler, more efficient, and more robust construction compared to contemporary switches. Examples of the disclosure are applicable to scenarios requiring fast, efficient, and safe switching of either (1) a single electrical current source between two electrical current loads; or (2) two electrical current sources between a single electrical current load. Thus, the disclosure can be configured based on the intended application to facilitate either an uninterrupted supply of power (via switching between a main and auxiliary power source) or the non-simultaneous use of a single power source by two electrical loads.

Figure 1A:
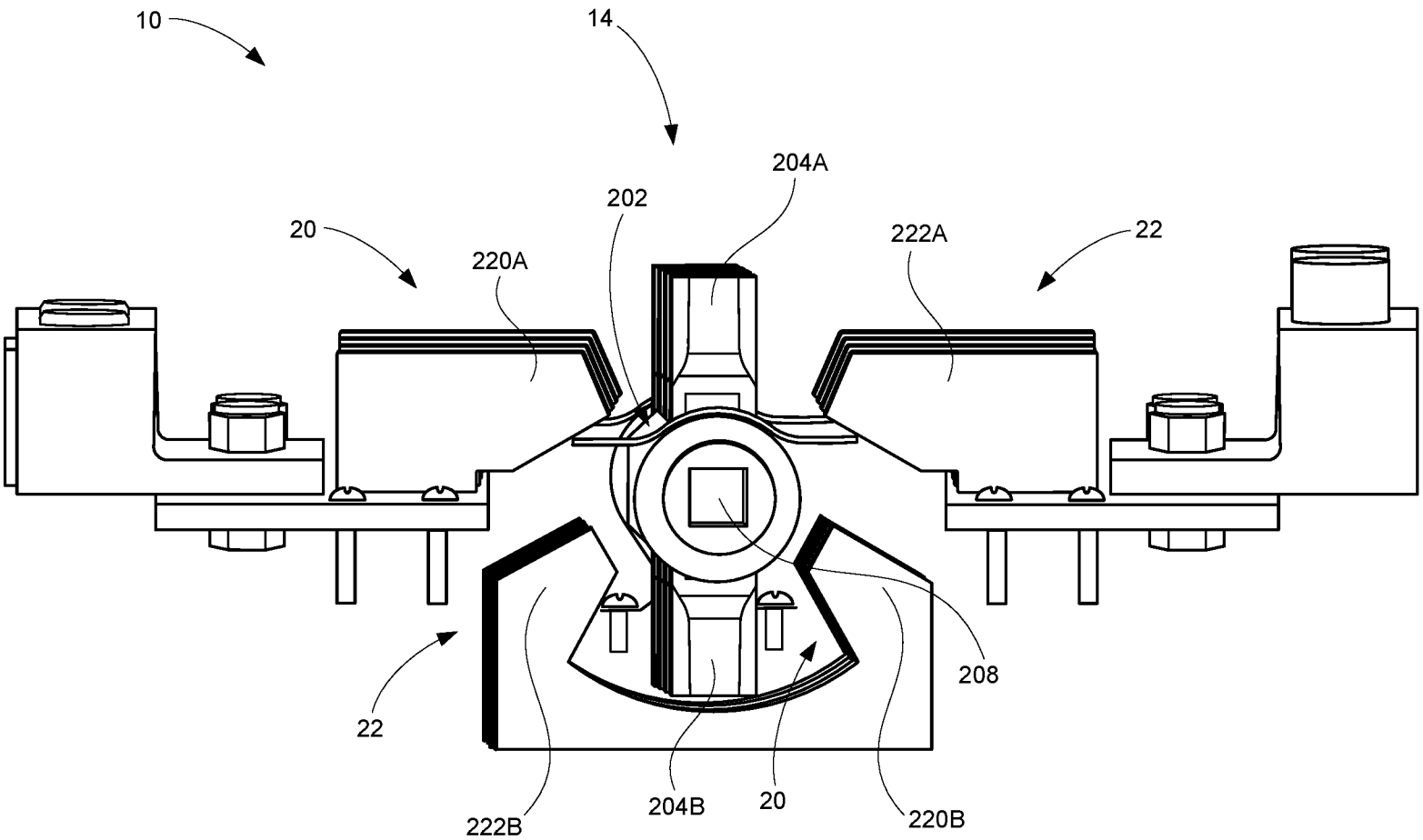
FIG. 1A is an exemplary perspective view illustrating an example of a switch in an open position.
Figure 1B:
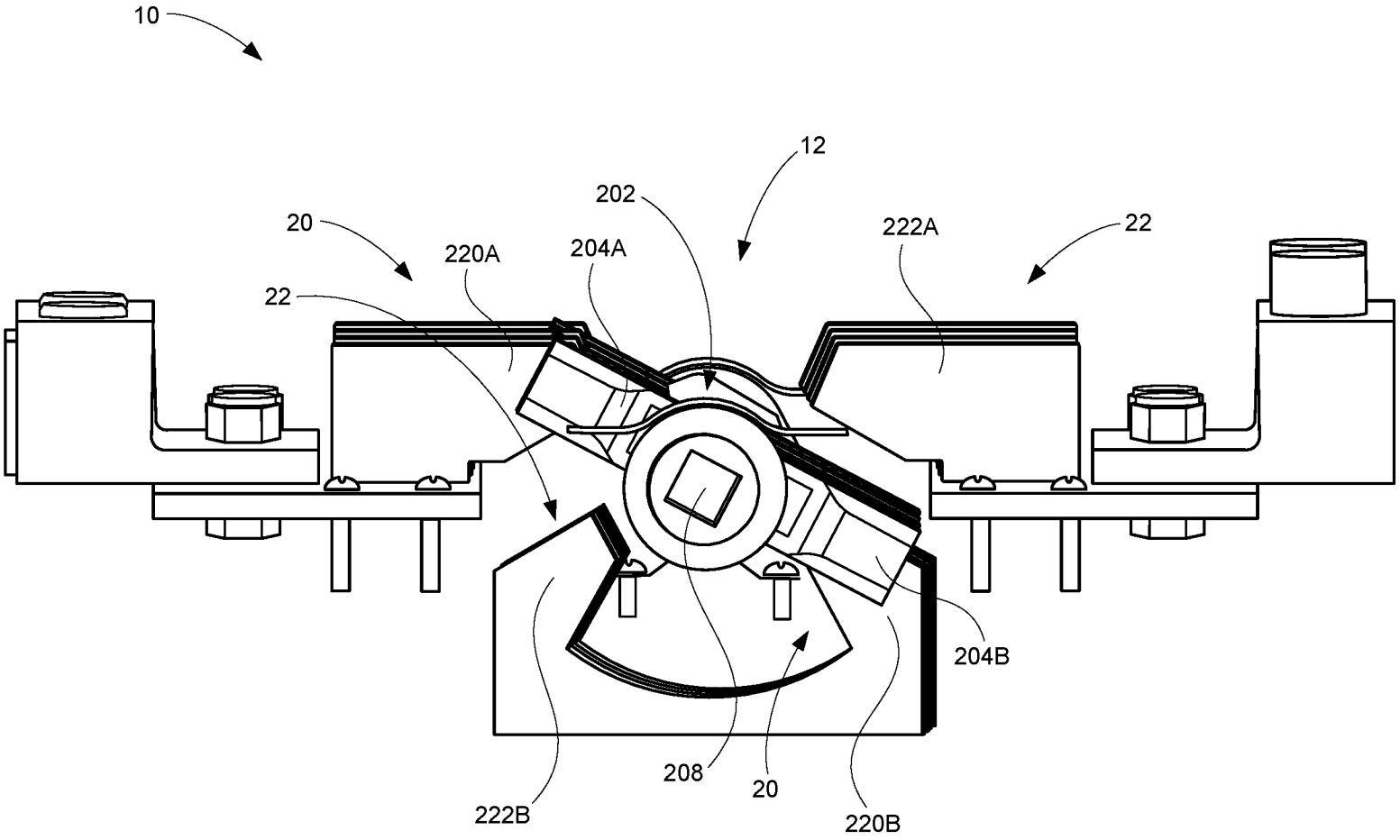
FIG. 1B is an exemplary perspective view illustrating an example of a switch in a first closed position.
Figure 1C:
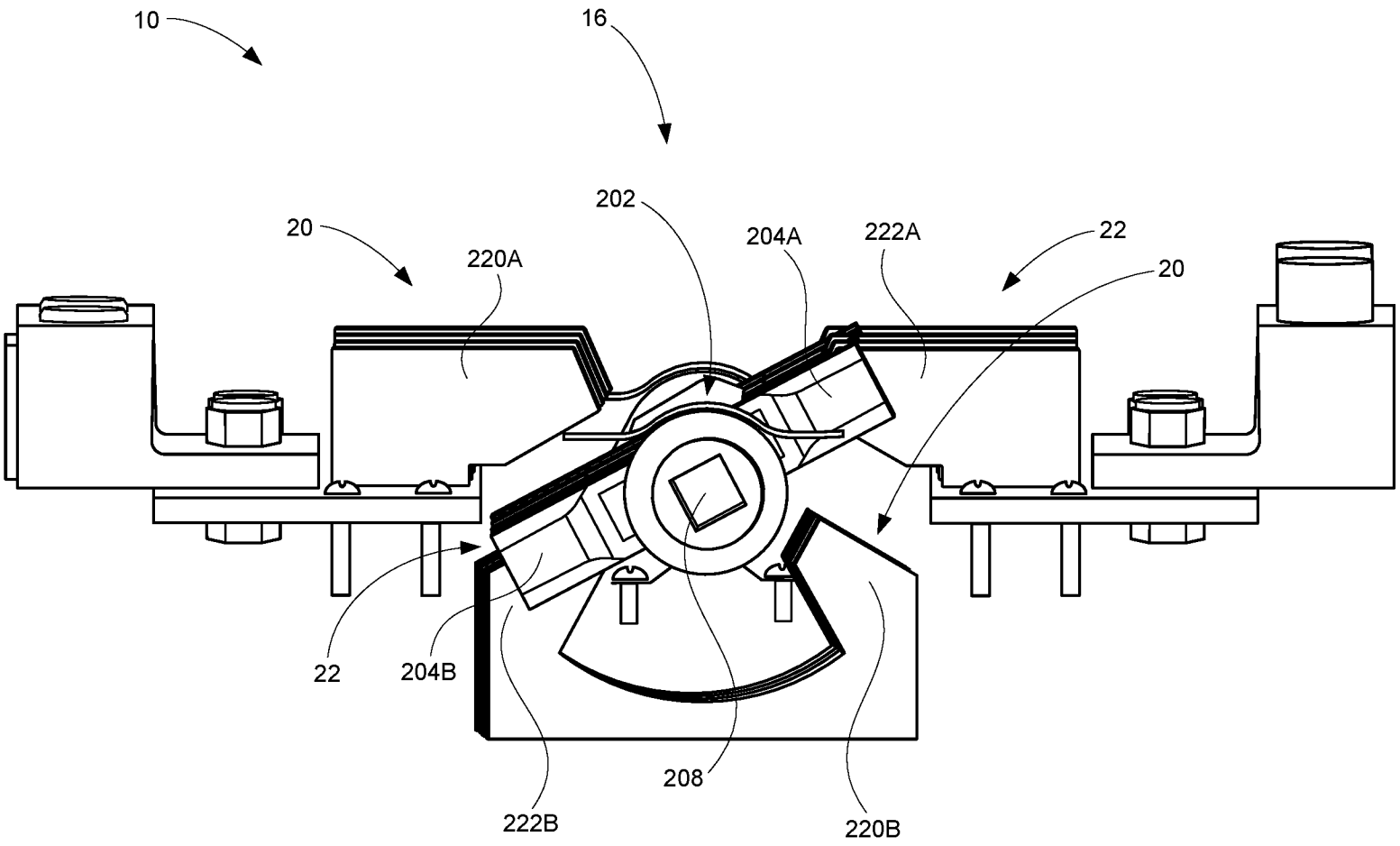
FIG. 1C is an exemplary perspective view illustrating an example of a switch in a second closed position.

Referring now to FIG. 1A, FIG. 1B, and FIG. 1C, exemplary perspective views illustrate an example of a switch 10 in an open position 14, a first closed position 12, and a second closed position 16, respectively. The first closed position 12 corresponds to a first electrical circuit (also called a first throw). The second closed position 16 corresponds to a second electrical circuit (also called a second throw). The switch 10 includes a first set of electrical contacts 20 and a second set of electrical contacts 22. More particularly, the first set of electrical contacts 20 includes one or more electrical contacts 220A and one or more electrical contacts 220B, while the second set of electrical contacts 22 includes one or more electrical contacts 222A and one or more electrical contacts 220B. The switch 10 includes a rotating shaft 202 that holds one or more contact bridges 204A and one or more contact bridges 204B, as is shown in FIGS. 1A, 1B, and 1C. The contact bridges 204A and 204B are electrically connected together such that corresponding contact bridges 204A and 204B define a single, continuous electrical pathway.

The switch 10 has an off position (also referred to as the open position 14) that is depicted in FIG. 1A. In the off position of the switch 10, the first set of electrical contacts 20 is open and the second set of electrical contacts 22 is open. More particularly, neither of the contact bridges 204A or 204B is engaged in electrical contact with any of the electrical contacts 220 or 222 such that the first and second set of electrical contacts 20 and 22, respectively, are both in the open position 14 thereof, as shown in FIG. 1A. When the switch 10 is in the off position such that the first and second sets of electrical contacts 20 and 22, respectively, are in the open position 14, no electrical current passes through the switch 10 to either the first throw or the second throw.

As depicted in FIG. 1B, when the switch 10 is in the first closed position 12, the first set of electrical contacts 20 is closed and the second set of electrical contacts 22 is open. More particularly, the contact bridge 204A is engaged in electrical contact with the electrical contact 220A of the first set of electrical contacts 20, while the contact bridge 204B is engaged in electrical contact with the electrical contact 220B of the first set of electrical contacts 20. Accordingly, the contact bridges 204A and 204B provide an electrical bridge between the electrical contacts 220A and 220B. The first closed position 12 of the switch 10 shown in FIG. 1B thus closes the first electrical circuit. Closure of the first electrical circuit conducts electricity between a source and any electrically powered device(s) connected to the first electrical circuit.

As depicted in FIG. 1C, when the switch 10 is in the second closed position 16, the first set of electrical contacts 20 is open and the second set of electrical contacts 22 is closed. More particularly, the contact bridge 204A is engaged in electrical contact with the electrical contact 222A of the second set of electrical contacts 22, while the contact bridge 204B is engaged in electrical contact with the electrical contact 222B of the second set of electrical contacts 22. Accordingly, the contact bridges 204A and 204B provide an electrical bridge between the electrical contacts 222A and 222B. The second closed position 16 of the switch 10 shown in FIG. 1C thus closes the second electrical circuit. Closure of the second electrical circuit conducts electricity between a source and any electrically powered device(s) connected to the second electrical circuit.

The arrangement, configuration, manner of operation, and/or the like of the switch 10 is meant as exemplary only. The switch 10 can have other arrangements, configurations, manners of operation, and/or the like in other embodiments. For example, the exemplary embodiment of the first and second sets of electrical contacts 20 and 22, respectively, each include two contacts 220A, 220B, 222A, 222B, as well as two contact bridges 204A and two contact bridges 204B. But, each of the first and second sets of electrical contacts 20 and 22, respectively, can include any number of the electrical contacts 220A, 220B, 222A, 222B, any number of the contact bridges 204A, and any number of the contact bridges 204B. Optionally, corresponding contact bridges 204A and 204B are formed as a single, unitary structure, as is shown in the example of FIGS. 1A, 1B, and 1C. Although shown as blades, each of the electrical contacts 220A, 220B, 222A, 222B, and each of the contact bridges 204A and 204B, can additionally or alternatively include any other type of electrical contact having any other shape. Moreover, although corresponding electrical contacts 220B and 222B are shown herein as being formed as a single, unitary structure, in other embodiments the electrical contacts 220B and 222B are separate physical structures such that each of the first and second sets of electrical contacts 20 and 22, respectively, includes one or more dedicated electrical contacts 220B and 222B, respectively.

Figure 2:
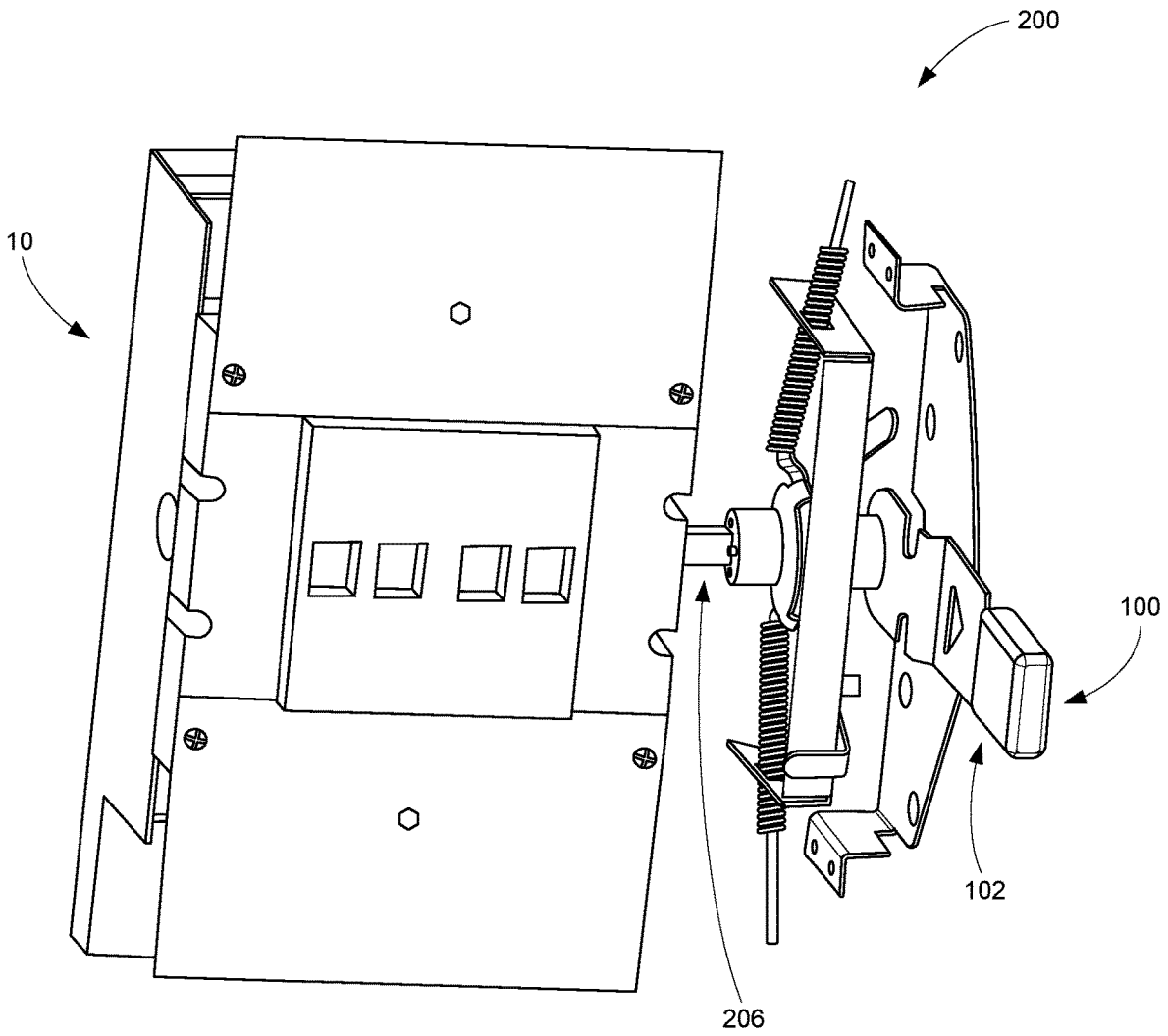
FIG. 2 is an exemplary perspective partially exploded view illustrating an example of a switch assembly that includes an example of a switching mechanism.

Referring now to FIG. 2, an exemplary perspective partially exploded view illustrates an example of a switch assembly 200. The switch assembly 200 includes the switch 10 and a switching mechanism 100. The switching mechanism 100 is operatively connected to the switch 10 for actuating the switch between the open position 14 (shown in FIG. 1A) and the first closed position 12 (shown in FIG. 1B) and the second closed position 16 (shown in FIG. 1C). The structure and function of the switching mechanism 100 is discussed in further detail elsewhere herein. FIG. 2 is an example of how, in some examples, the switch assembly 200, having the switch 10, is operatively connected to the switching mechanism 100. More particularly, the switch assembly 200 includes a rod 206 that is connected between the switching mechanism 100 and the shaft 202 (shown in FIGS. 1A, 1B, and 1C) of the switch 10. The rod 206 is interconnected between the switching mechanism 100 and the shaft 202 such that the shaft 202 and the switching mechanism 100 are operatively connected together. In other words, the rod 206 is connected to both the switching mechanism 100 and the shaft 202 of the switch 10 such that the switching mechanism 100 is configured to move the switch 10 between the open position 14 and the first and second closed positions 12 and 16, respectively. In the exemplary embodiment, the rod 206 is rectangular and fits within a rectangular opening 208 (shown in FIGS. 1A, 1B, and 1C) of the shaft 202 and a rectangular opening 210 (shown in FIG. 4A) of a connector 212 (shown in FIGS. 3 and 4A) of the switching mechanism 100 to operatively interconnect the switching mechanism 100 and the switch 10. But, the rod 206 additionally or alternatively can include any other structure, arrangement, shape, configuration, and/or the like that enables the rod 206 to operatively connect the switching mechanism 100 to the shaft 202 of the switch 10. For example, the rod 206 is formed as a single, unitary structure with the shaft 202 and/or the connector 212 in some other embodiments.

Figure 3:
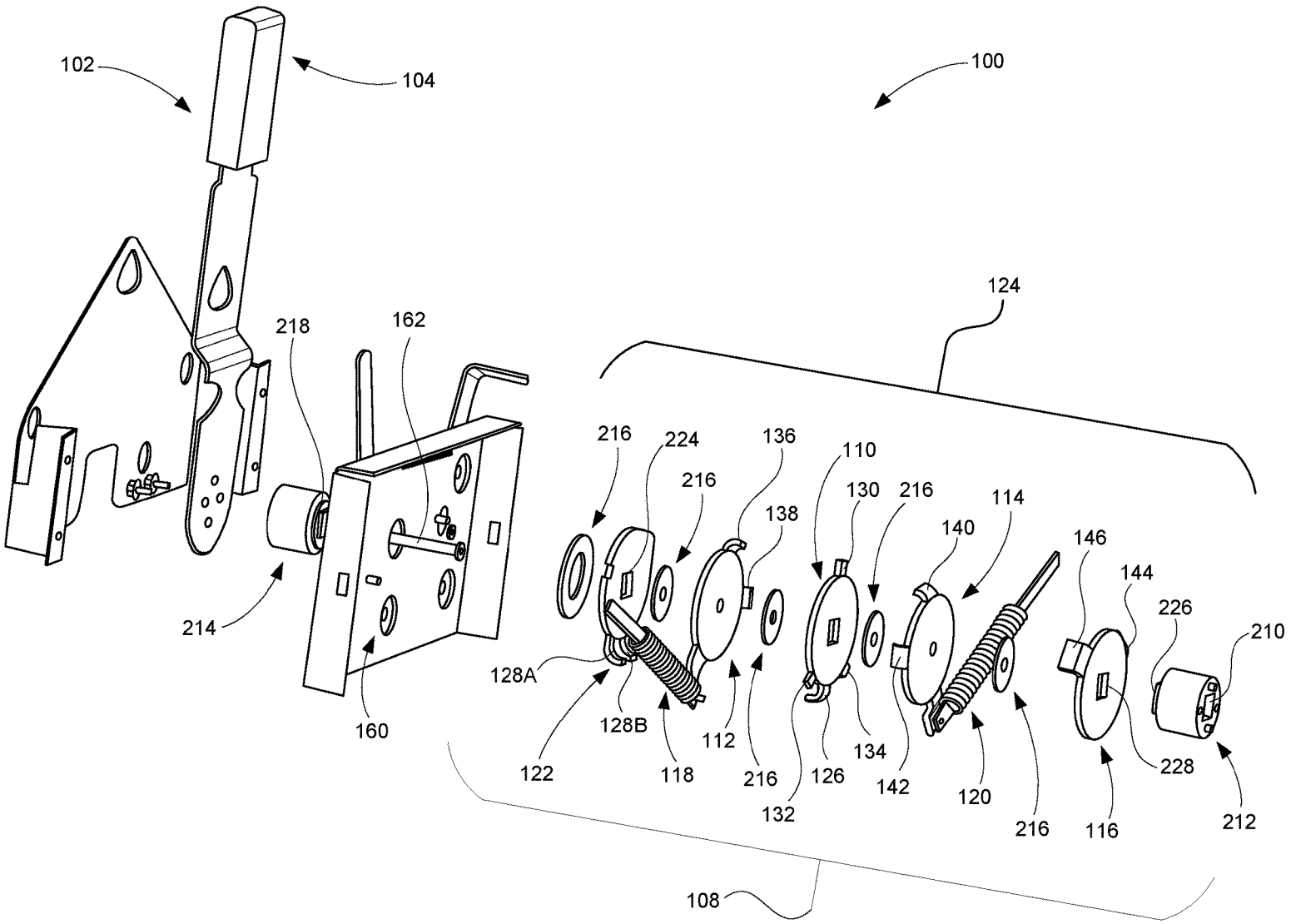
FIG. 3 is an exemplary exploded view illustrating an example of the switching mechanism.

Referring now to FIG. 3, an exemplary exploded view illustrates an example of the switching mechanism 100. In some examples, the switching mechanism 100 includes a mounting plate 160. As will be described below, the various components of the switching mechanism 100 are secured to the mounting plate 160 via an exemplary arrangement that includes the connector 212, another connector 214, spacers 216, and a rod 162. In addition or alternatively to the mounting plate 160, the connector 212, the connector 214, the spacers 216, the rod 162 and/or the exemplary connection arrangement shown herein, the switching mechanism 100 can include any other arrangement, components, structures, connectors, fasteners, spacers, and/or the like that enables the switching mechanism 100 to function as described and/or illustrated herein, such as, but not limited to, screws, nails, washers, spacers, bolts, cams, and/or the like.

In the exemplary embodiment, the switching mechanism 100 includes an actuator 102 and a timing disc assembly 108. The actuator 102 is moveable between an off position 104 (shown in FIGS. 2, 3, 4A, and 8) and one or more on positions 106 (shown in FIGS. 4E and 6D). In the exemplary embodiment, the actuator 102 is fixedly secured to the connector 214 for rotation therewith. The exemplary embodiment of the timing disc assembly 108 includes an actuator disc 110, a bias disc 112, a bias disc 114, a switch disc 116, a biasing mechanism 118, and a biasing mechanism 120. The timing disc assembly 108 optionally includes an actuator linkage disc 122. As is shown in FIG. 3, the actuator linkage disc 122, actuator disc 110, the bias disc 112, the bias disc 114, and the switch disc 116 are arranged in a stack 124 such that the actuator linkage disc 122, actuator disc 110, the bias disc 112, the bias disc 114, and the switch disc 116 overlay each other. In the example shown in FIG. 3, the actuator disc 110 is arranged within the stack 124 between the bias disc 112 and the bias disc 114, with the discs 110, 112, and 114 arranged between the switch disc 116 and the actuator linkage disc 122. Accordingly, the actuator disc 110 is arranged within the stack 124 between the bias disc 112 and the switch disc 116 in the exemplary embodiment. But, the various discs 110, 112, 114, 116, and 122 can have any other relative arrangement within the stack 124 that enables the switching mechanism 100 to function as described and/or illustrated herein. Each of the bias disc 112 and the bias disc 114 may be referred to herein as a "first bias disc" and/or a "second bias disc". Each of the biasing mechanism 118 and the biasing mechanism 120 may be referred to herein as a "first biasing mechanism" and a "second biasing mechanism".

The rod 162 is received through the timing disc assembly 108 and is connected to both the connectors 214 and 212 to hold the timing disc assembly 108 together. The actuator linkage disc 122 is rotatably connected to the actuator 102 for rotation therewith. In the exemplary embodiment, the connector 214 includes a rectangular protrusion 218 that is received within a rectangular opening 224 of the actuator linkage disc 122 to interlock the connector 214 and the actuator linkage disc 122 such the actuator linkage disc 122 and the actuator 102 rotate together. But, any other arrangement, configuration, shape (e.g., of the opening 224 and/or the protrusion 218, etc.), and/or the like can be used to rotatably connect the actuator 102 to the actuator linkage disc 122.

The exemplary embodiment of the actuator disc 110 includes a flange 126 that is received between a pair of flanges 128A and 128B of the actuator linkage disc 122 to link the actuator disc 110 to the actuator linkage disc 122 for rotation therewith, as will be described below. The actuator disc 110 also includes flanges 130, 132, and 134. The bias disc 112 includes flanges 136 and 138, while the bias disc 114 includes flanges 140 and 142. The switch disc 116 includes flanges 144 and 146. Operation of the various flanges to drive rotation of the various discs will be described below. The flange 130 of the actuator disc 110 may referred to herein as a "first actuator flange", while each of the flanges 132 and 134 of the actuator disc 110 may be referred to herein as a "second actuator flange". Each of the flange 136 of the bias disc 112 and the flange 140 of the bias disc 114 may be referred to herein as a "first bias flange". Each of the flange 138 of the bias disc 112 and the flange 140 of the bias disc 114 may be referred to herein as a "second bias flange". Each of the flanges 144 and 146 of the switch disc 116 may be referred to herein as a "switch flange".

Figure 4A:
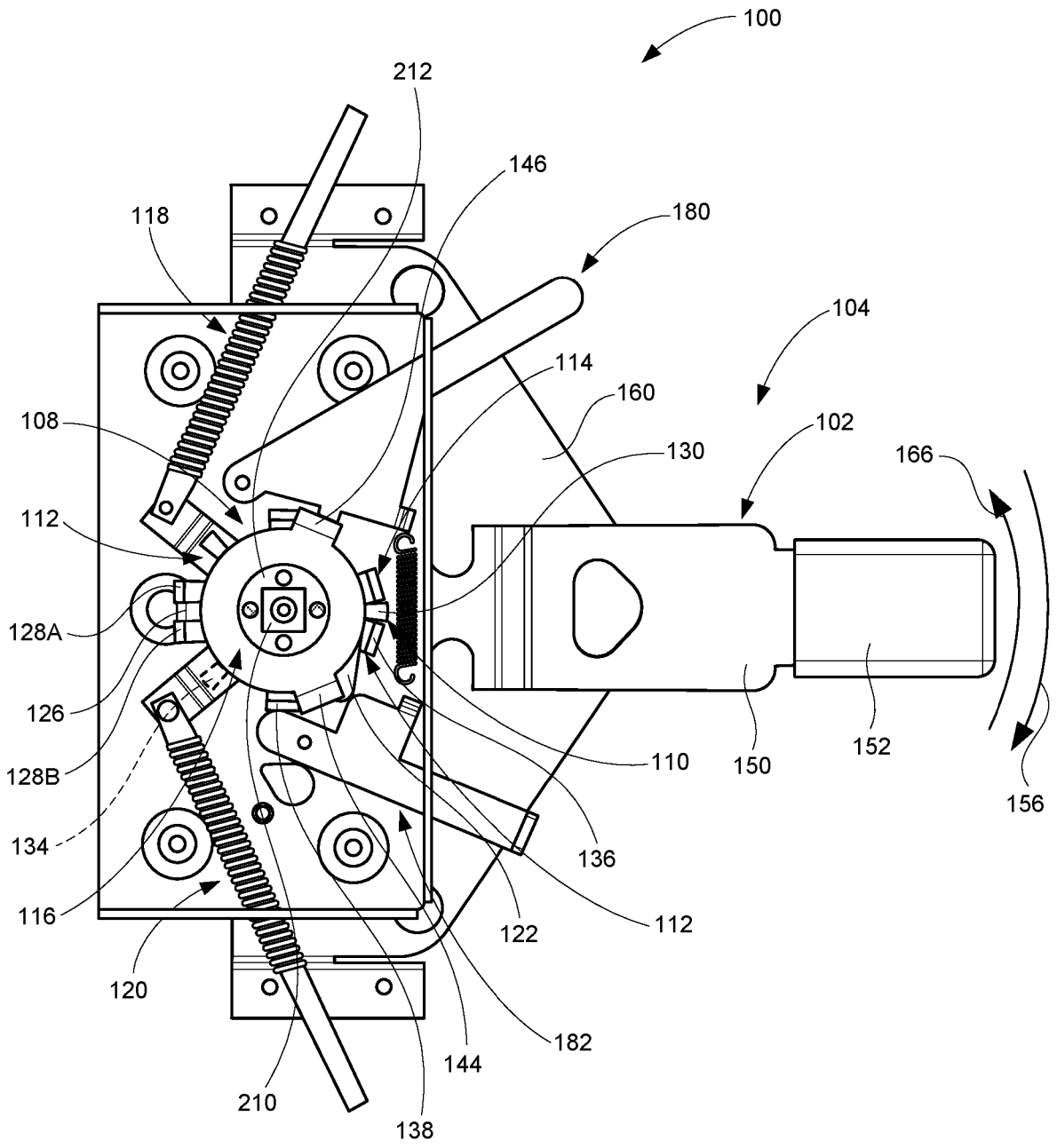
FIG. 4A is an exemplary side elevational view illustrating an example a switching mechanism with a switch in an open position.

Referring now to FIG. 4A, the switching mechanism 100 is shown with the actuator 102 in the off position 104 that corresponds to an open position (e.g., the open position 14 shown in FIG. 1A) of a switch (e.g., the switch 10 shown in FIG. 1A). The actuator 102 is moveable (i.e., rotatable) between the off position 104 and one or more on positions 106. In the exemplary embodiment, the switching mechanism 100 is a double throw switch wherein: (1) the actuator 102 is moveable between the off position 104 that corresponds to the open position of the switch and a first on position 106A (shown in FIG. 4E) that corresponds to a first closed position (e.g., the first closed position 12 of the switch 10 shown in FIG. 1B); and (2) the actuator 102 is moveable between the off position 104 that corresponds to the open position of the switch and a second on position 106B (shown in FIG. 6D) that corresponds to a second closed position (e.g., the second closed position 16 of the switch 10 shown in FIG. 1C). In other embodiments, the switching mechanism 100 can be used as a single throw switch wherein the actuator 102 is moveable between the off position 104 that corresponds to an open position of the switch and a single on position that corresponds to a closed position of the switch (e.g., the first closed position 12 or the second closed position 16). It should be understood that various components shown and/or described herein may not be included in the switching mechanism 100 in embodiments wherein the switching mechanism 100 defines a single throw switch (e.g., the switching mechanism 100 may not include one of the bias discs 112 or 114, one of the biasing mechanisms 118 or 120, etc.).

In the exemplary embodiment, the actuator 102 includes a lever 150 having a handle 152 that is configured to be grasped by a user to move (i.e., rotate) the actuator 102 between the off position 104 and the on positions 106A and 106B. The actuator disc 110 is rotatably connected to the actuator 102 such that the actuator disc 110 is configured to rotate with the actuator 102. In the example shown herein, the actuator disc 110 is rotatably connected to the actuator 102 via the actuator linkage disc 122. For example, the actuator linkage disc 122 is rotatably connected to the actuator 102 for rotation therewith as described above. The flange 126 of the actuator disc 110 is received between the flanges 128A and 128B of the actuator linkage disc 122 such that the actuator disc 110 is interlocked with the actuator linkage disc 122. Accordingly, the actuator disc 110 is configured to rotate along with the actuator linkage disc 122 and thereby the actuator 102. But, any other arrangement, configuration, and/or the like can be used to rotatably connect the actuator disc 110 to the actuator 102 for rotation therewith in addition or alternatively to the actuator linkage disc 122. For example, the actuator disc 110 can be fixedly connected to, and/or interlocked with, the actuator 102 in other embodiments.

The bias disc 112 is operatively connected to the biasing mechanism 118, while the bias disc 114 is operatively connected to the biasing mechanism 120. The switch disc 116 is operatively connected to the switch 10 such that rotation of the switch disc 116 is configured to move the switch 10 between the open position 14 and the first closed position 12 of the switch 10 and is configured to move the switch 10 between the open position 14 and the second closed position 16 of the switch 10. In the exemplary embodiment, the connector 212 includes a rectangular protrusion 226 (shown in FIG. 3) that is received within a rectangular opening 228 (shown in FIG. 3) of the switch disc 116 to interlock the connector 212 and the switch disc 116 such the switch disc 116 and the shaft 202 (shown in FIGS. 1A, 1B, and 1C) rotate together. But, any other arrangement, configuration, shape (e.g., of the protrusion 226 and/or the opening 228, etc.), and/or the like can be used to operatively connect the switch disc 116 to the switch 110.

As will be described in more detail below, the actuator disc 110 is configured to engage the bias disc 112 such that the actuator disc 110 is configured to rotate the bias disc 112 to overcenter positions 148 (shown in FIG. 4D) and 170 (shown in FIG. 5D) of the biasing mechanism 118. The overcenter positions 148 and 170 of the biasing mechanism 118 are configured to rotate the bias disc 112 such that engagement between the bias disc 112 and the switch disc 116 is configured to rotate the switch disc 116 between the first closed position 12 and the open position 14 of the switch 10.

As will also be described in more detail below, the actuator disc 110 is configured to engage the bias disc 114 such that the actuator disc 110 is configured to rotate the bias disc 114 to overcenter positions 154 (shown in FIG. 6C) and 172 (shown in FIG. 7D) of the biasing mechanism 120. The overcenter positions 154 and 172 of the biasing mechanism 120 are configured to rotate the bias disc 114 such that engagement between the bias disc 114 and the switch disc 116 is configured to rotate the switch disc 116 between the second closed position 16 and the open position 14 of the switch 10.

Figure 4B:
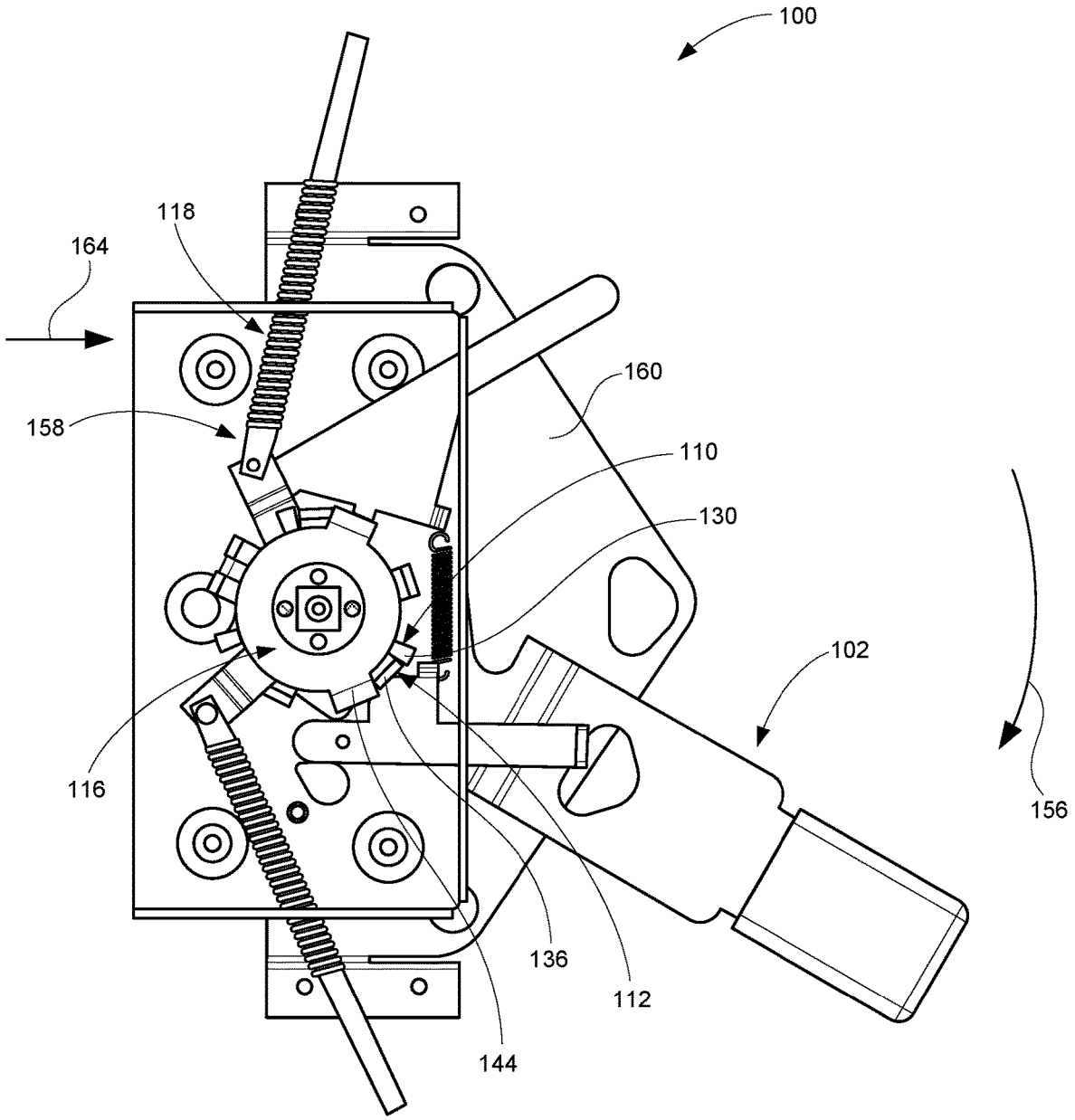
FIGS. 4B-4E are exemplary side elevational views illustrating an example of a switching mechanism wherein a switch is transitioning from an open position to a first closed position.

FIG. 4A illustrates the actuator 102 of the switching mechanism 100 in the off position that corresponds to the open position 14 of the switch 10 shown in FIG. 1A. As can be seen in FIG. 4A, the flange 130 of the actuator disc 110 is engaged in physical contact with the flange 136 of the bias disc 112 in the off position 104 of the actuator 102. To move the switch 10 to the first closed position 12 shown in FIG. 1B, the actuator 102 is rotated in the direction of the arrow 156 (i.e., clockwise) relative to the mounting plate 160 as is shown in FIG. 4B. As the actuator 102 is rotated in the direction 156 from the off position 104 shown in FIG. 4A to the position shown in FIG. 4B, the actuator disc 110 is rotated in the direction 156 along with the actuator 102. The engagement between the flange 130 of the actuator disc 110 and the flange 136 of the bias disc 112 rotates the bias disc 112 in the direction 156 to the position shown in FIG. 4B, wherein the flange 136 of the bias disc 112 is engaged in physical contact with the flange 144 of the switch disc 116. As is also shown in FIG. 4B, the rotation of the actuator 102 in the direction 156 has moved an end portion 158 of the biasing mechanism 118 in the direction of the arrow 164 toward the overcenter position 148 (shown in FIG. 4D) of the biasing mechanism 118.

Figure 4C:
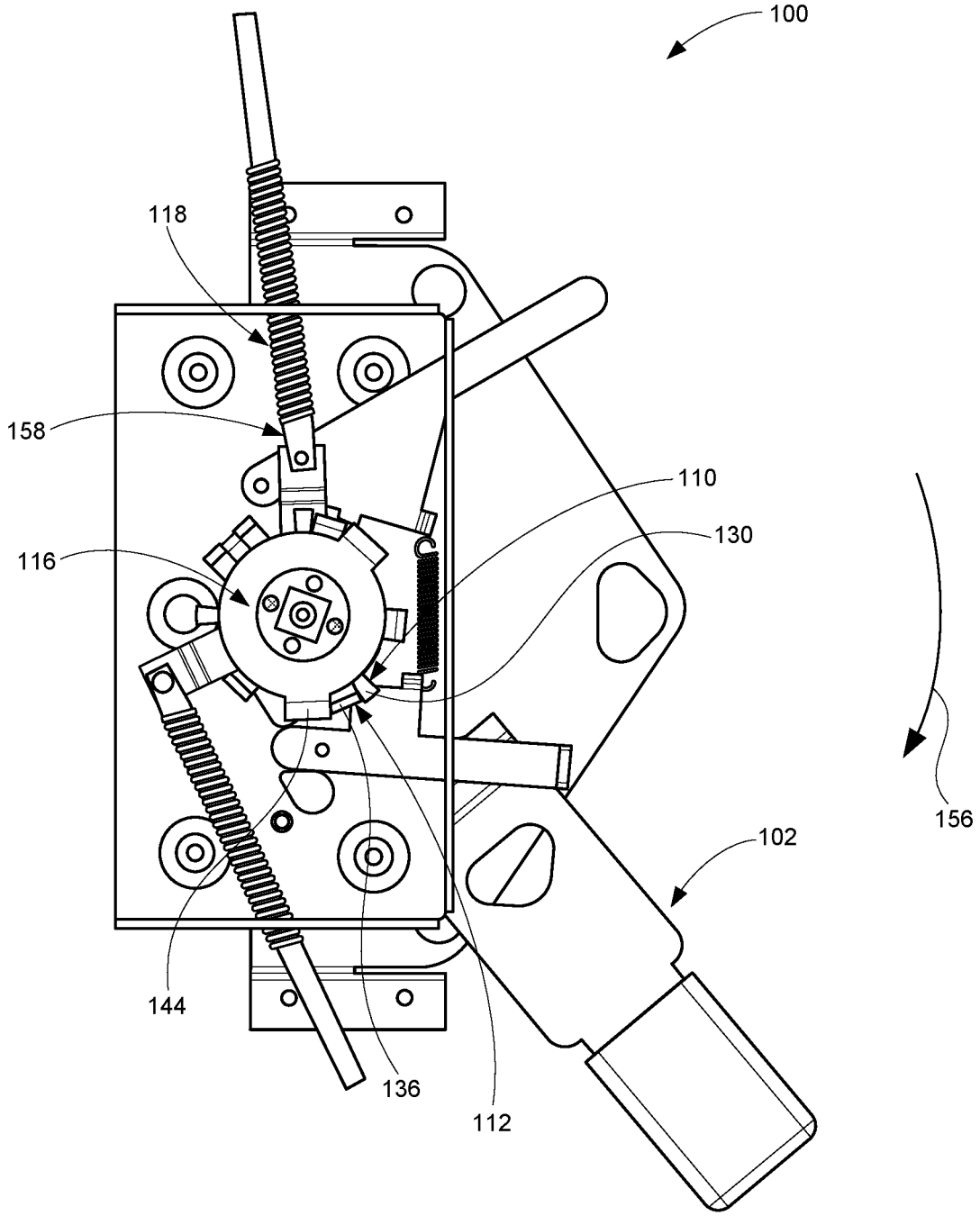

Continued rotation of the actuator 102 in the direction 156 advances the actuator disc 110, the bias disc 112, and the switch disc 116 in the direction 156 to the positions shown in FIG. 4C. Moreover, the continued rotation of the actuator 102 in the direction 156 shown between FIGS. 4B and 4C moves the end portion 158 of the biasing mechanism 118 further toward to the overcenter position 148 shown in FIG. 4D. In the position of the switching mechanism 100 shown in FIG. 4C, the end portion 158 of the biasing mechanism 118 is at an approximately centered position. As can be seen in FIG. 4C, the flange 130 of the actuator disc 110 remains engaged with the flange 136 of the bias disc 112, and the flange 136 of the bias disc 112 remains engaged with the flange 144 of the switch disc 116 in the position of the switching mechanism 100 shown in FIG. 4C.

Figure 4D:
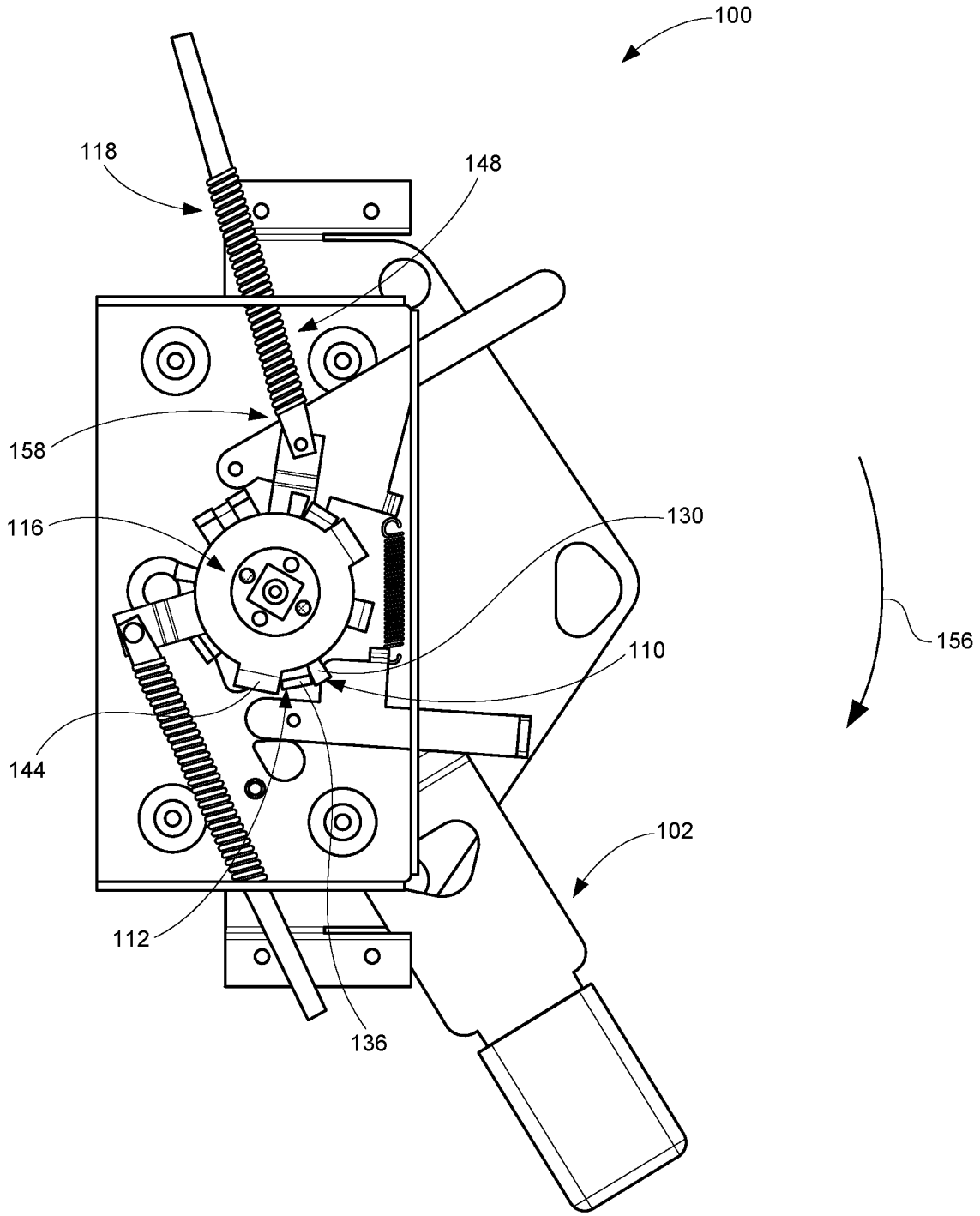
Figure 4E:
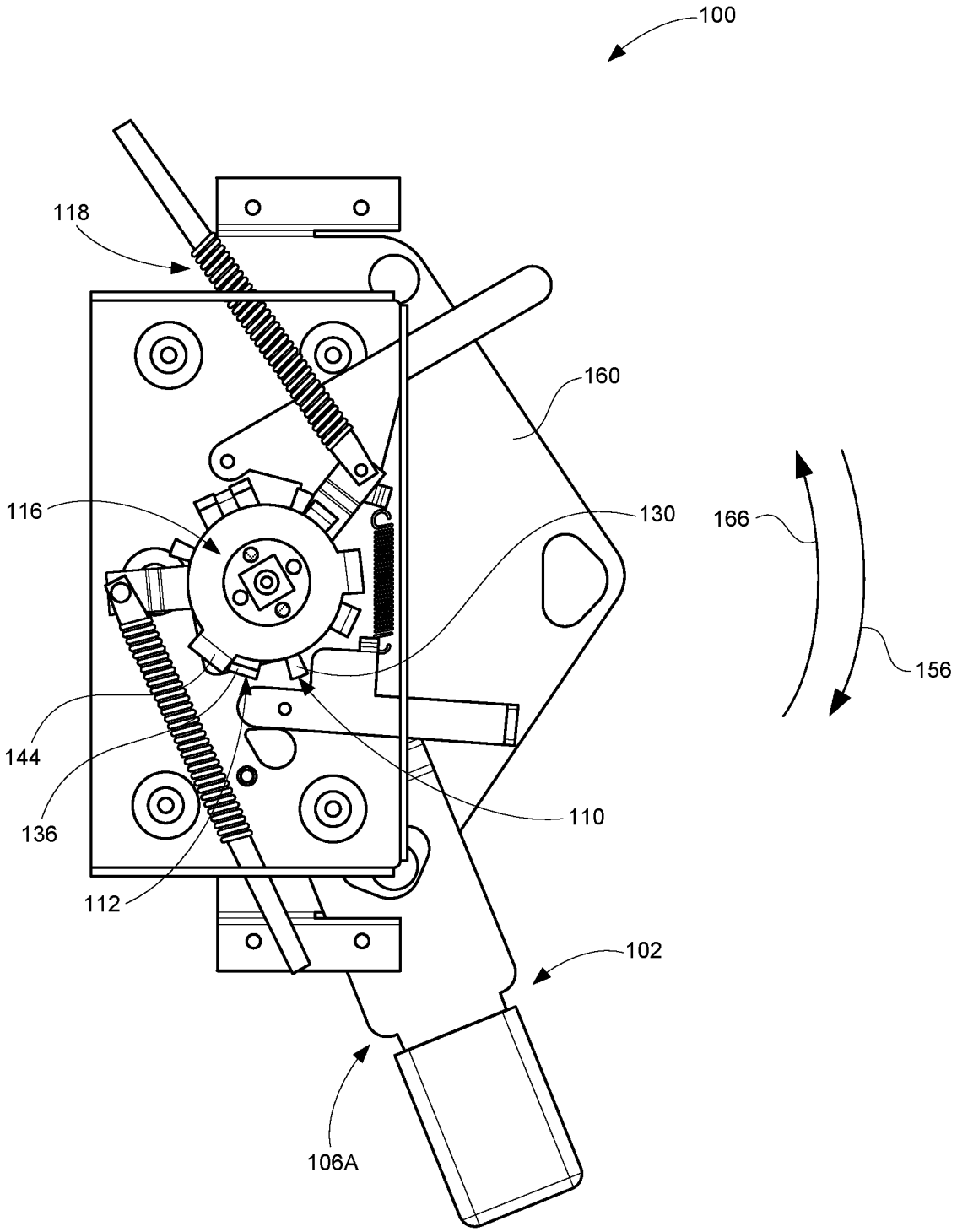

As shown in FIG. 4D, further continued rotation of the actuator 102 in the direction 156 moves the end portion 158 of the biasing mechanism 118 to the overcenter position 148 wherein the bias of the biasing mechanism 118 acts to further rotate the bias disc 112 in the direction 156. In the position of the switching mechanism 100 shown in FIG. 4D, the flange 130 of the actuator disc 110 remains engaged with the flange 136 of the bias disc 112. But, at this position in the movement of the switching mechanism 100, the bias exerted on the bias disc 112 by the overcenter position 148 of the biasing mechanism 118 drives further rotation of the bias disc 112 in the direction 156 instead of the actuator 102. As the biasing mechanism 118 rotates the bias disc 112 further in the direction 156 from the position shown in FIG. 4D to the position shown in FIG. 4E, the engagement between the flange 136 of the bias disc 112 and the flange 144 of the switch disc 116 rotates the switch disc 116 in the direction 156 from the position shown in FIG. 4D to the position in FIG. 4E. As can be seen in FIG. 4E, the flange 130 of the actuator disc 110 separates from the flange 136 of the bias disc 112 as the biasing mechanism 118 rotates the bias disc 112 (and thereby the switch disc 116) from the position of the switching mechanism 100 shown in FIG. 4D to the position shown in FIG. 4E, even as the actuator 102 (and thereby the actuator disc 110) continue to rotate in the direction 156 to the first on position 106A of the actuator 102 shown in FIG. 4E.

The position of the switch disc 116 shown in FIG. 4E corresponds to the first closed position 12 of the switch 10. Accordingly, rotation of the actuator 102 from the off position 104 shown in FIG. 4A to the first on position 106A shown in FIG. 4E thereby moves the switch 10 from the open position 14 shown in FIG. 1A to the first closed position 12 shown in FIG. 1B.

Figure 5A:
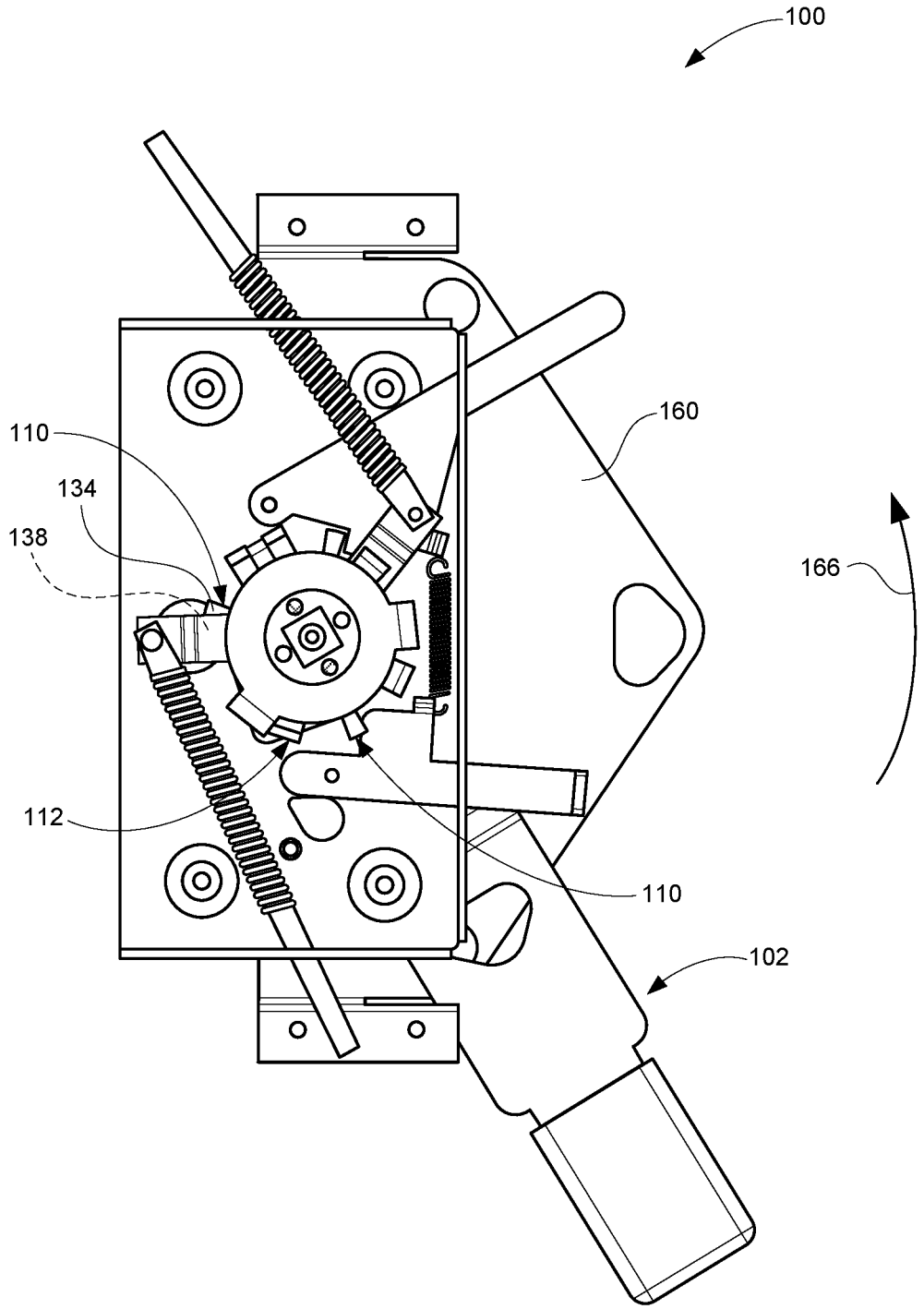
FIGS. 5A-5E are exemplary side elevational views illustrating an example of a switching mechanism wherein a switch is transitioning from a first closed position to an open position.
Figure 5B:
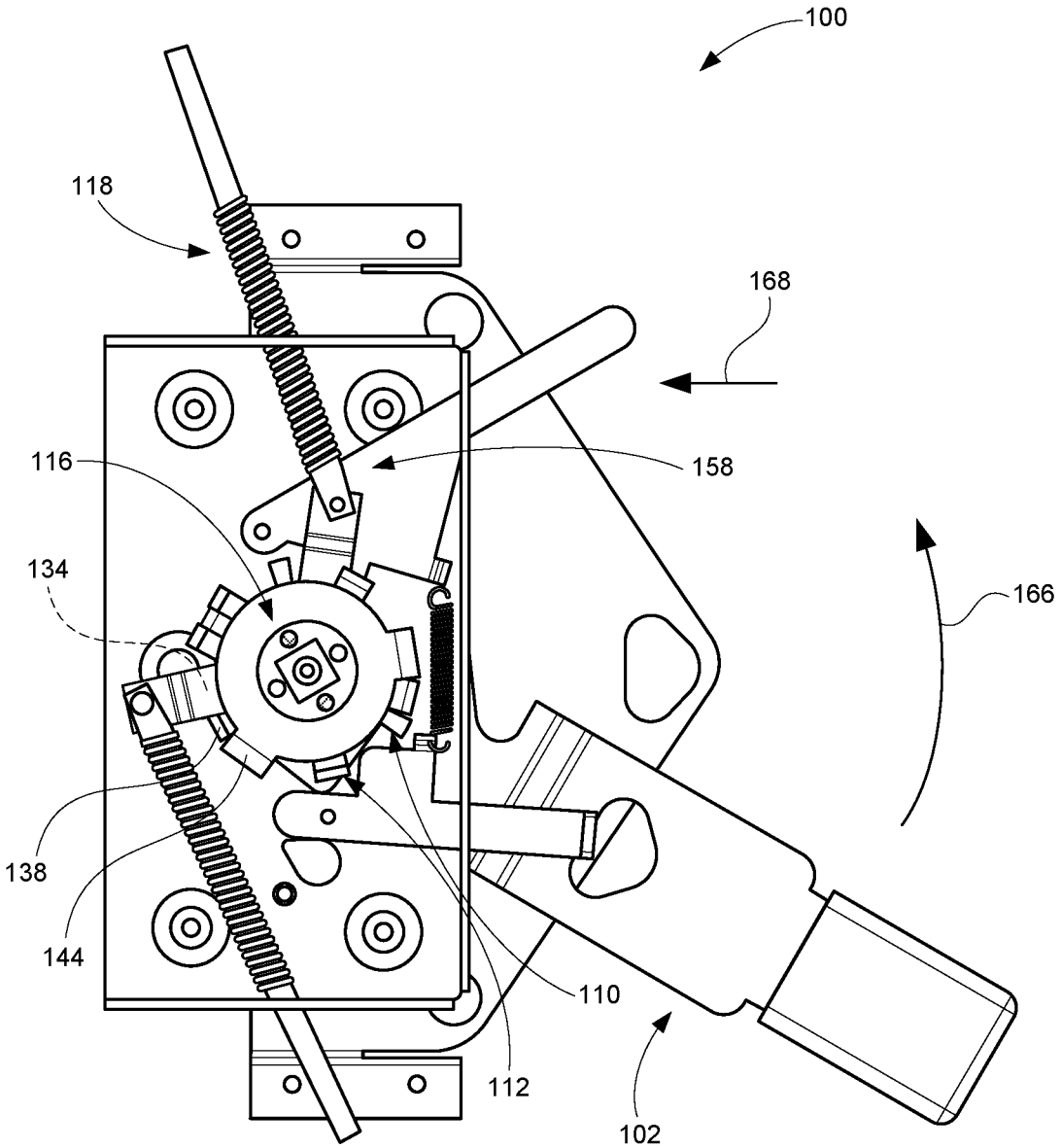

Movement of the actuator 102 from the first on position 106A to the off position 104 to thereby move the switch 10 from the first closed position 12 shown in FIG. 1B to the open position 14 shown in FIG. 1A will now be described with reference to FIGS. 4E-5E. To move the switch 10 from the first closed position 12 to the open position 14, the actuator 102 is rotated relative to the mounting plate 160 in the direction of the arrow 166 (i.e., counterclockwise). As the actuator 102 is rotated in the direction 166 from the first on position 106A shown in FIG. 4E to the position shown in FIG. 5A, the actuator disc 110 is rotated in the direction 166 along with the actuator 102 such that the flange 134 of the actuator disc 110 is moved into engagement in physical contact with the flange 138 (not visible in FIG. 5A) of the bias disc 112. As the actuator 102 is rotated further in the direction 166 from the position shown in FIG. 5A to the position shown in FIG. 5B, the engagement between the flange 134 (not visible in FIG. 5B) of the actuator disc 110 and the flange 138 of the bias disc 112 rotates the bias disc 112 in the direction 166 to the position shown in FIG. 5B, wherein the flange 138 of the bias disc 112 is engaged in physical contact with the flange 144 of the switch disc 116. As is shown in FIG. 5B, the rotation of the actuator 102 in the direction 166 has moved the end portion 158 of the biasing mechanism 118 in the direction of the arrow 168 toward an overcenter position 170 (shown in FIG. 5D) of the biasing mechanism 118.

Figure 5C:
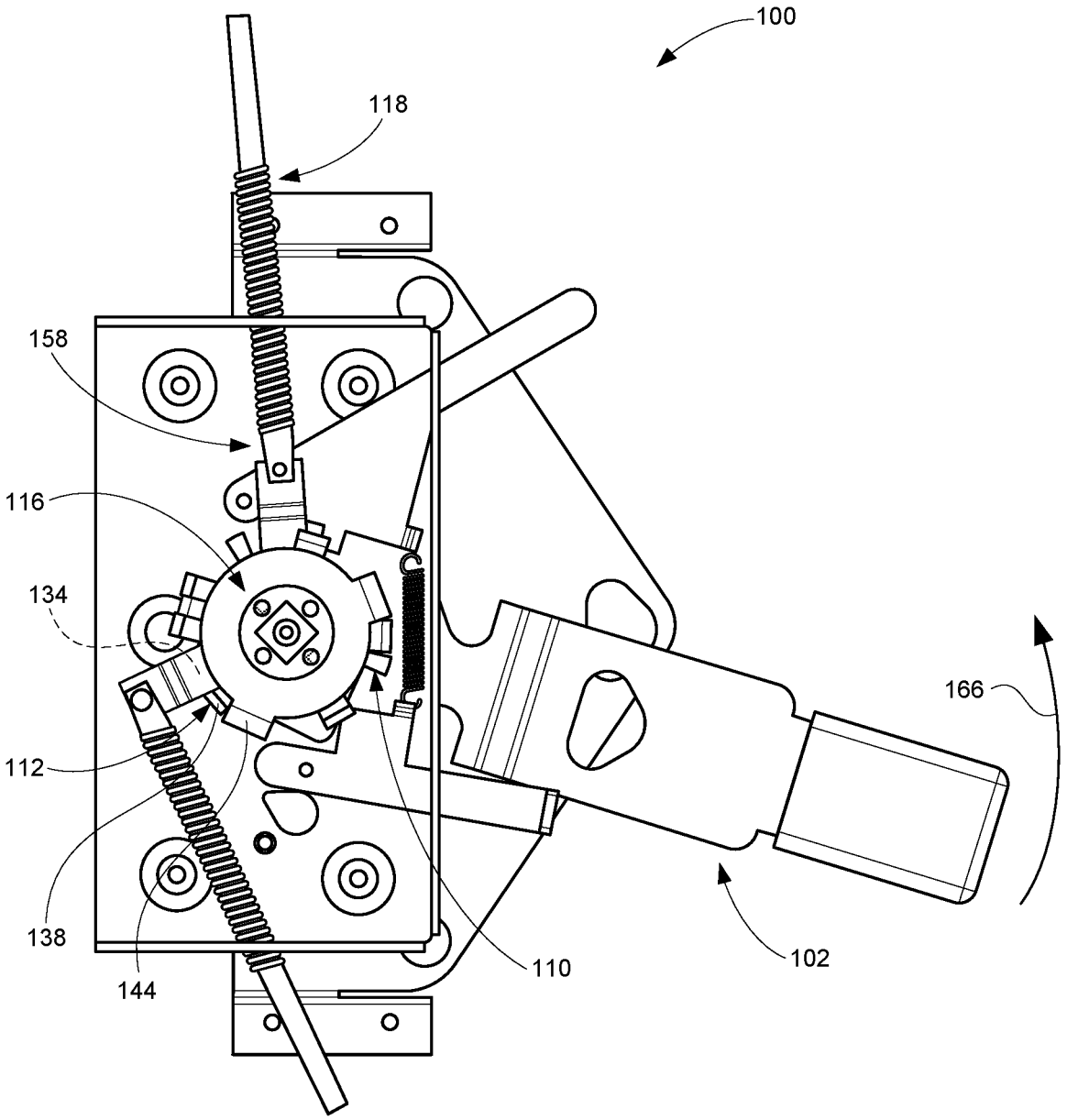

Continued rotation of the actuator 102 in the direction 166 advances the actuator disc 110, the bias disc 112, and the switch disc 116 in the direction 166 to the positions shown in FIG. 5C. Moreover, the continued rotation of the actuator 102 in the direction 166 shown between FIGS. 5B and 5C moves the end portion 158 of the biasing mechanism 118 further toward to the overcenter position 170 shown in FIG. 5D. In the position of the switching mechanism 100 shown in FIG. 5C, the end portion 158 of the biasing mechanism 118 is at an approximately centered position, the flange 134 (not visible in FIG. 5C) of the actuator disc 110 remains engaged with the flange 138 of the bias disc 112, and the flange 138 of the bias disc 112 remains engaged with the flange 144 of the switch disc 116 in the position of the switching mechanism 100 shown in FIG. 5C.

Figure 5D:
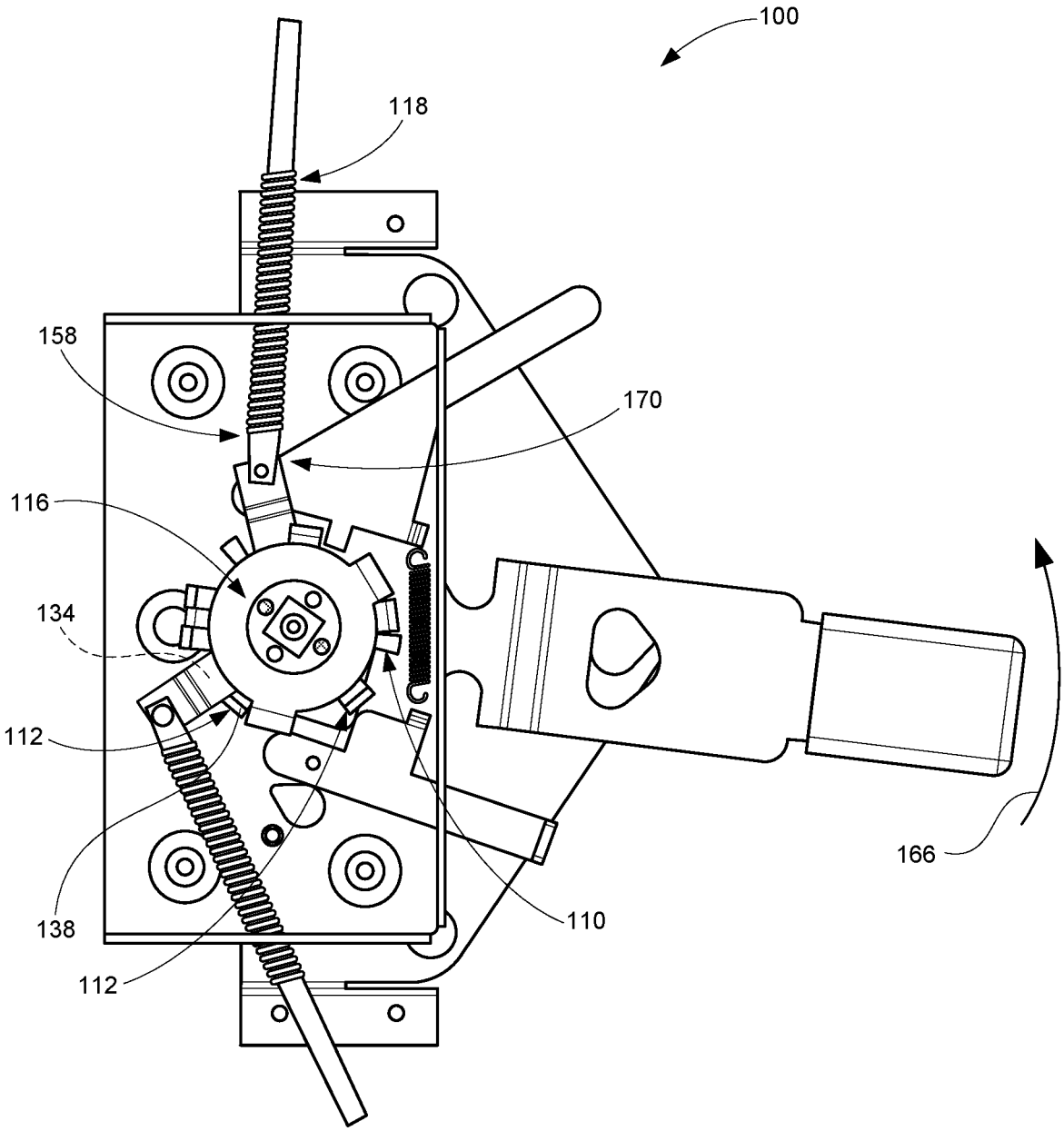
Figure 5E:
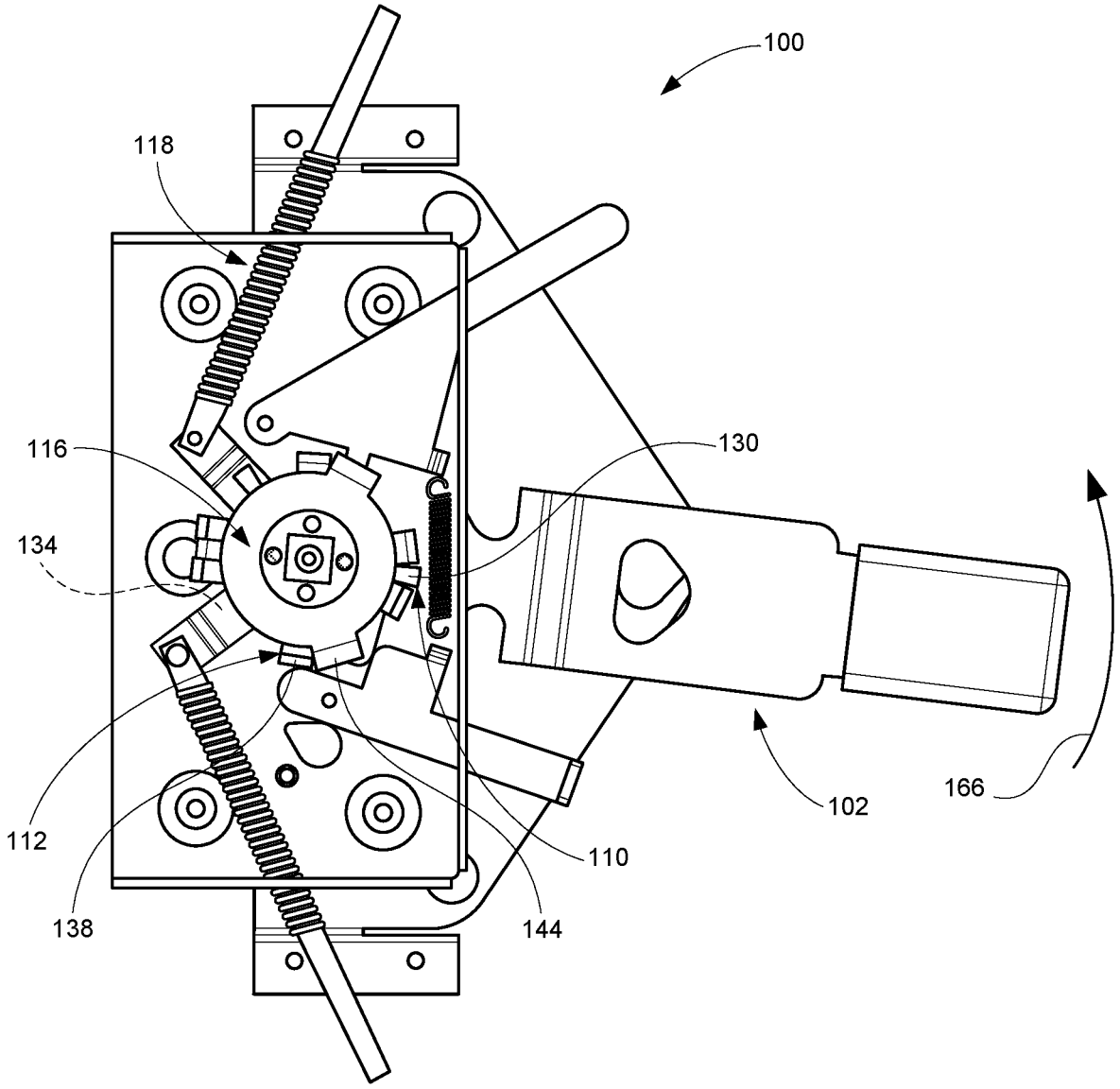

As shown in FIG. 5D, further continued rotation of the actuator 102 in the direction 166 moves the end portion 158 of the biasing mechanism 118 to the overcenter position 170 wherein the bias of the biasing mechanism 118 acts to further rotate the bias disc 112 in the direction 166. In the position of the switching mechanism 100 shown in FIG. 5D, the flange 134 (not visible in FIG. 5D) of the actuator disc 110 remains engaged with the flange 138 of the bias disc 112. But, at this position in the movement of the switching mechanism 100, the bias exerted on the bias disc 112 by the overcenter position 170 of the biasing mechanism 118 drives further rotation of the bias disc 112 in the direction 166 instead of the actuator 102. As the biasing mechanism 118 rotates the bias disc 112 further in the direction 166 from the position shown in FIG. 5D to the position shown in FIG. 5E and ultimately to the position of FIG. 4A, the engagement between the flange 138 of the bias disc 112 and the flange 144 of the switch disc 116 rotates the switch disc 116 in the direction 166 from the position shown in FIG. 5D to the position in FIG. 5E and ultimately to the position shown in FIG. 4A. As should be apparent from FIG. 5E, the flange 134 (not visible in FIG. 5E) of the actuator disc 110 separates from the flange 138 of the bias disc 112 as the biasing mechanism 118 rotates the bias disc 112 (and thereby the switch disc 116) from the position of the switching mechanism 100 shown in FIG. 5D to the position shown in FIG. 5E, even as the actuator 102 (and thereby the actuator disc 110) continues to rotate in the direction 166 to the open position 104 of FIG. 4A.

The position of the switch disc 116 shown in FIG. 4A corresponds to the open position 14 of the switch 10. Accordingly, rotation of the actuator 102 from the first on position 106A shown in FIG. 4E to the off position 104 shown in FIG. 4A thereby moves the switch 10 from the first closed position 12 shown in FIG. 1B to the open position 14 shown in FIG. 1A.

Figure 6A:
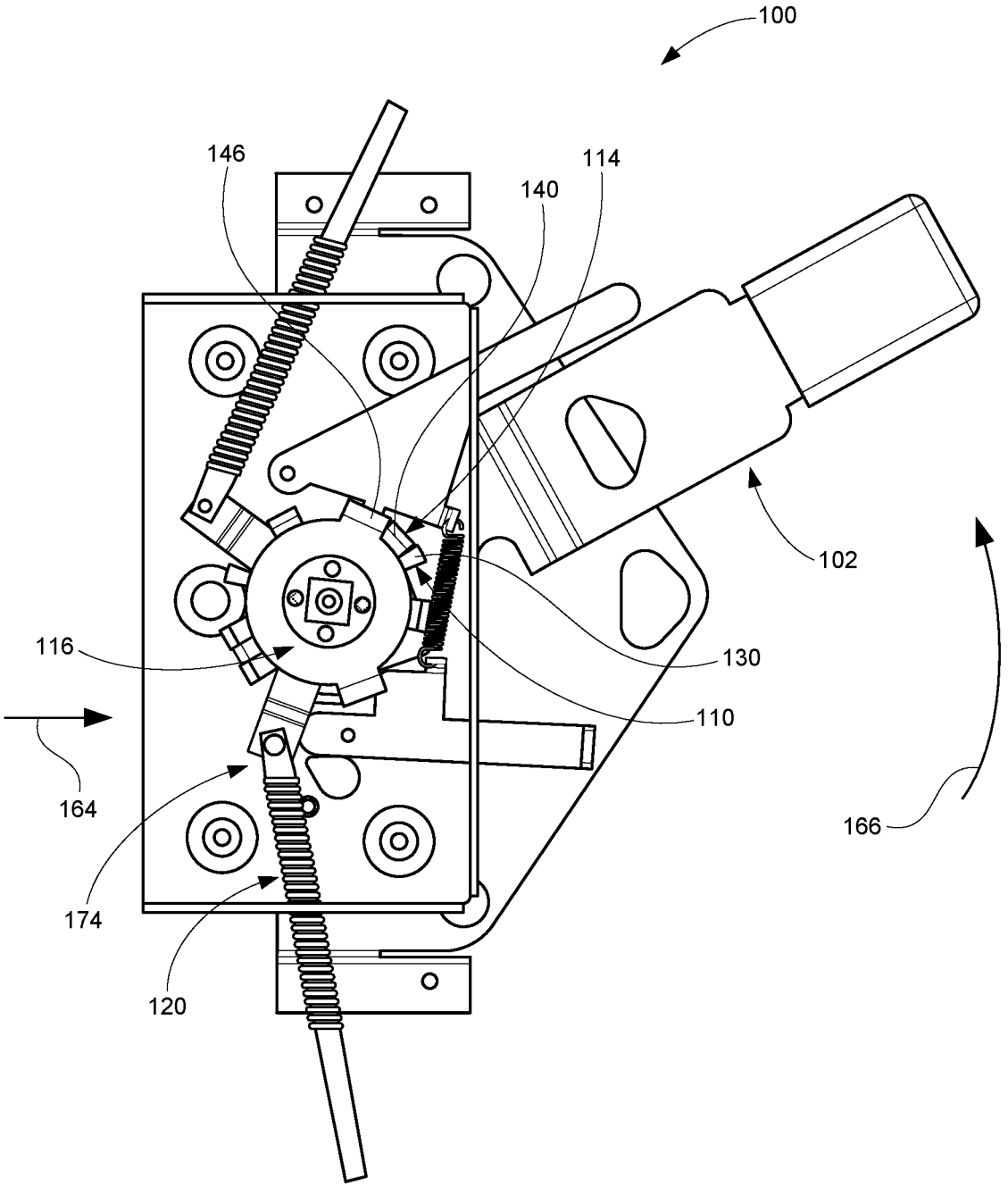
FIGS. 6A-6D are exemplary side elevational views illustrating an example of a switching mechanism wherein a switch is transitioning from an open position to second closed position.

As described above, FIG. 4A illustrates the actuator 102 of the switching mechanism 100 in the off position that corresponds to the open position 14 of the switch 10 shown in FIG. 1A. As can be seen in FIG. 4A, the flange 130 of the actuator disc 110 is engaged in physical contact with the flange 140 of the bias disc 114 in the off position 104 of the actuator 102. To move the switch 10 to the second closed position 16 shown in FIG. 1C, the actuator 102 is rotated in the direction of the arrow 166 (i.e., counter-clockwise) relative to the mounting plate 160 as is shown in FIG. 6A. As the actuator 102 is rotated in the direction 166 from the off position 104 shown in FIG. 4A to the position shown in FIG. 6A, the actuator disc 110 is rotated in the direction 166 along with the actuator 102. The engagement between the flange 130 of the actuator disc 110 and the flange 140 of the bias disc 114 rotates the bias disc 114 in the direction 166 to the position shown in FIG. 6A, wherein the flange 140 of the bias disc 114 is engaged in physical contact with the flange 146 of the switch disc 116. As is also shown in FIG. 6A, the rotation of the actuator 102 in the direction 166 has moved an end portion 174 of the biasing mechanism 120 in the direction of the arrow 164 toward the overcenter position 154 (shown in FIG. 6C) of the biasing mechanism 120.

Figure 6B:
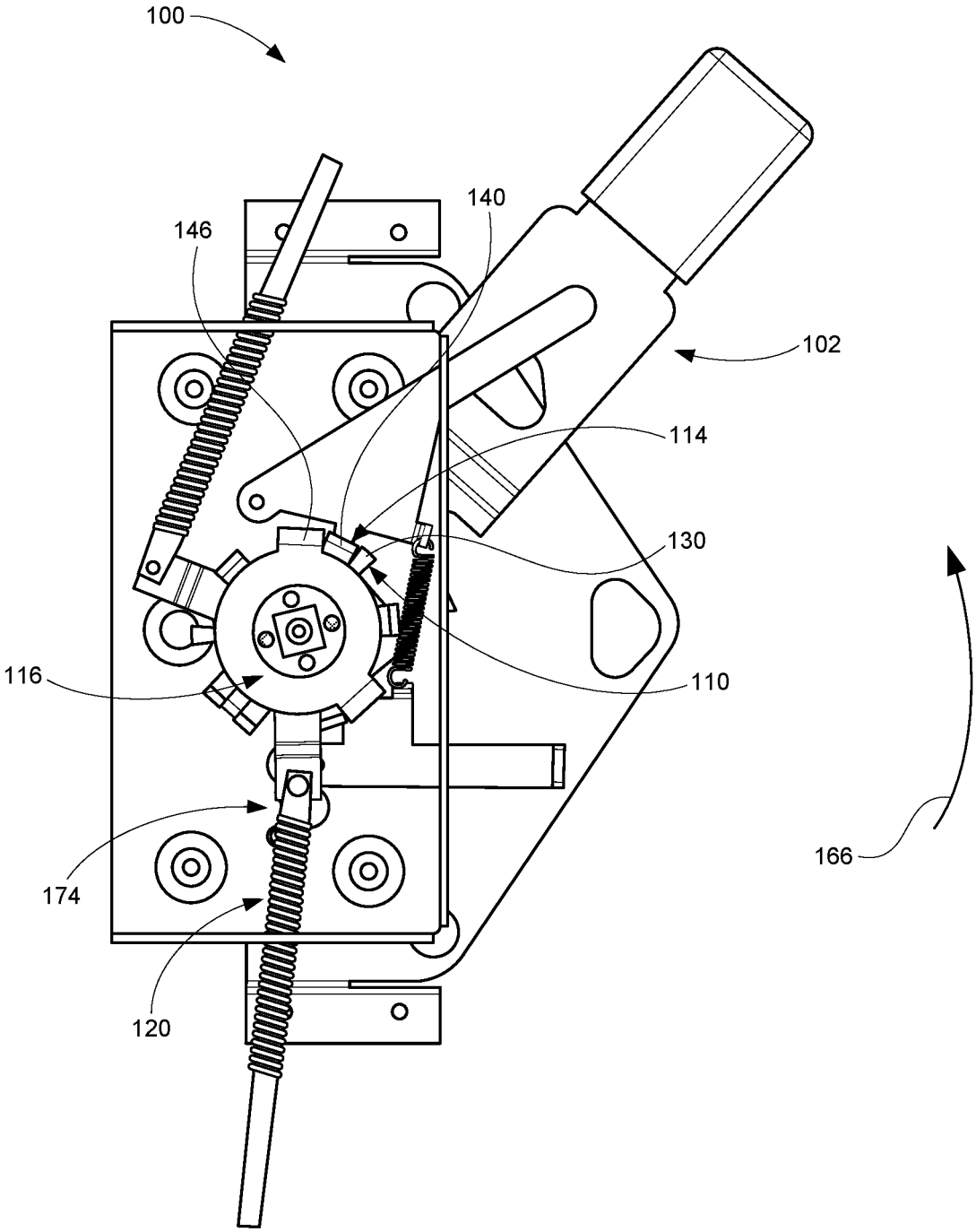

Continued rotation of the actuator 102 in the direction 166 advances the actuator disc 110, the bias disc 114, and the switch disc 116 in the direction 166 to the positions shown in FIG. 6B. Moreover, the continued rotation of the actuator 102 in the direction 166 shown between FIGS. 6A and 6B moves the end portion 174 of the biasing mechanism 120 further toward to the overcenter position 154 shown in FIG. 6C. In the position of the switching mechanism 100 shown in FIG. 6B, the end portion 174 of the biasing mechanism 120 is at an approximately centered position. As can be seen in FIG. 6B, the flange 130 of the actuator disc 110 remains engaged with the flange 140 of the bias disc 114, and the flange 140 of the bias disc 114 remains engaged with the flange 146 of the switch disc 116 in the position of the switching mechanism 100 shown in FIG. 6B.

Figure 6C:
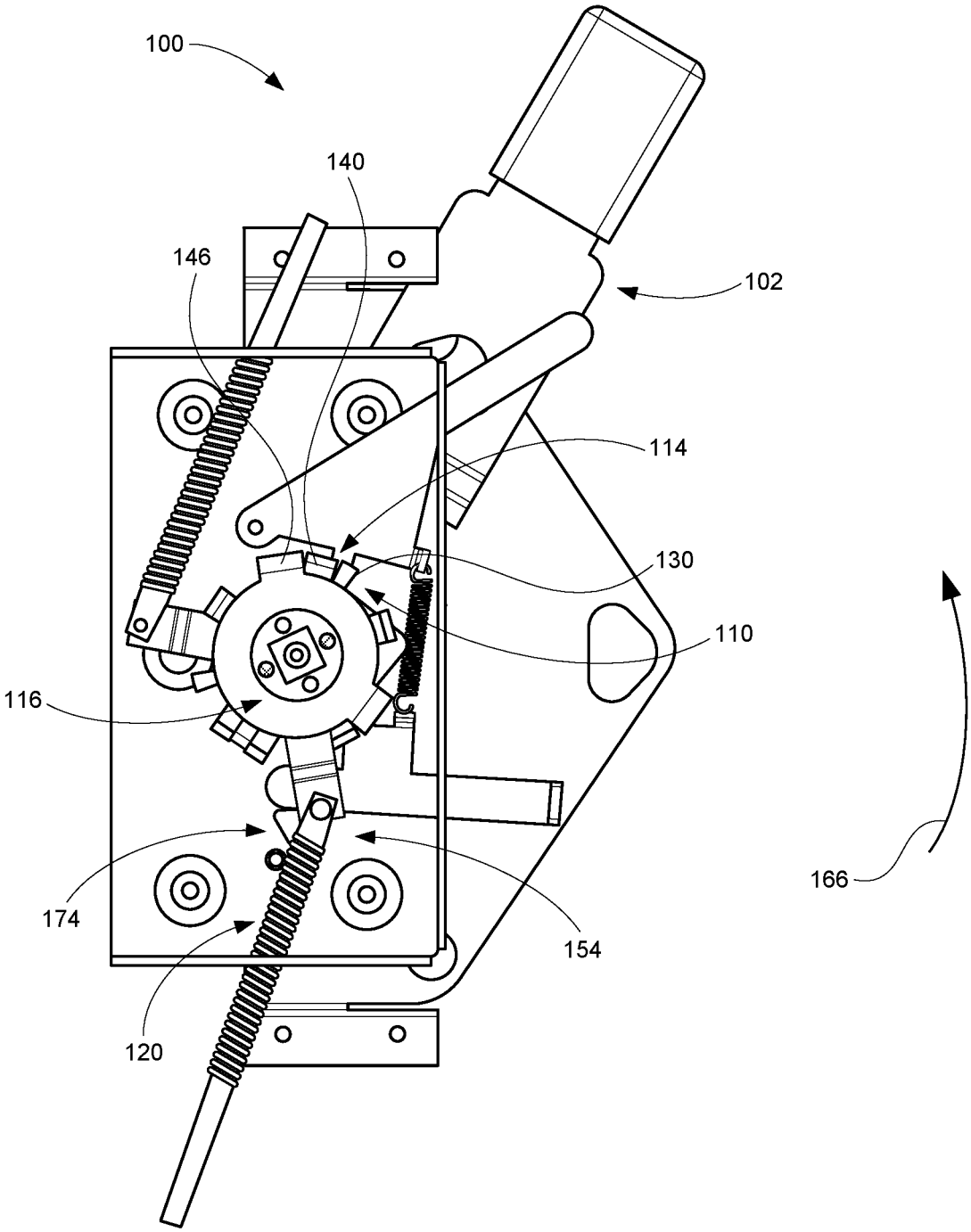
Figure 6D:
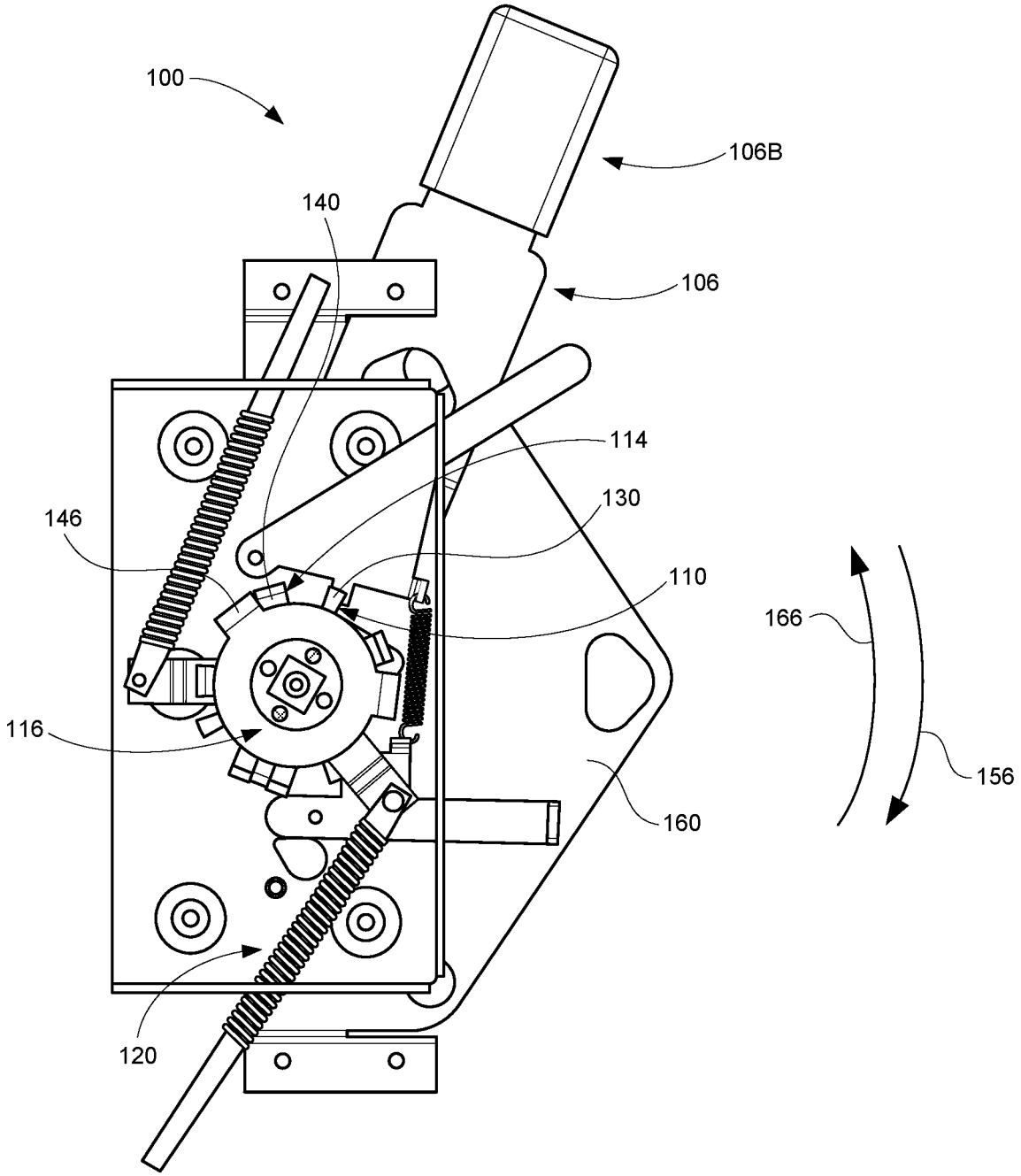

As shown in FIG. 6C, further continued rotation of the actuator 102 in the direction 166 moves the end portion 174 of the biasing mechanism 120 to the overcenter position 154 wherein the bias of the biasing mechanism 120 acts to further rotate the bias disc 114 in the direction 166. In the position of the switching mechanism 100 shown in FIG. 6C, the flange 130 of the actuator disc 110 remains engaged with the flange 140 of the bias disc 114. But, at this position in the movement of the switching mechanism 100, the bias exerted on the bias disc 114 by the overcenter position 154 of the biasing mechanism 120 drives further rotation of the bias disc 114 in the direction 166 instead of the actuator 102. As the biasing mechanism 120 rotates the bias disc 114 further in the direction 166 from the position shown in FIG. 6C to the position shown in FIG. 6D, the engagement between the flange 140 of the bias disc 114 and the flange 146 of the switch disc 116 rotates the switch disc 116 in the direction 166 from the position shown in FIG. 6C to the position in FIG. 6D. As can be seen in FIG. 6D, the flange 130 of the actuator disc 110 separates from the flange 140 of the bias disc 114 as the biasing mechanism 120 rotates the bias disc 114 (and thereby the switch disc 116) from the position of the switching mechanism 100 shown in FIG. 6C to the position shown in FIG. 6D, even as the actuator 102 (and thereby the actuator disc 110) continue to rotate in the direction 166 to the second on position 106B of the actuator 102 shown in FIG. 6D.

The position of the switch disc 116 shown in FIG. 6D corresponds to the second closed position 16 of the switch 10. Accordingly, rotation of the actuator 102 from the off position 104 shown in FIG. 4A to the second on position 106B shown in FIG. 6D thereby moves the switch 10 from the open position 14 shown in FIG. 1A to the second closed position 16 shown in FIG. 1C.

Figure 7A:
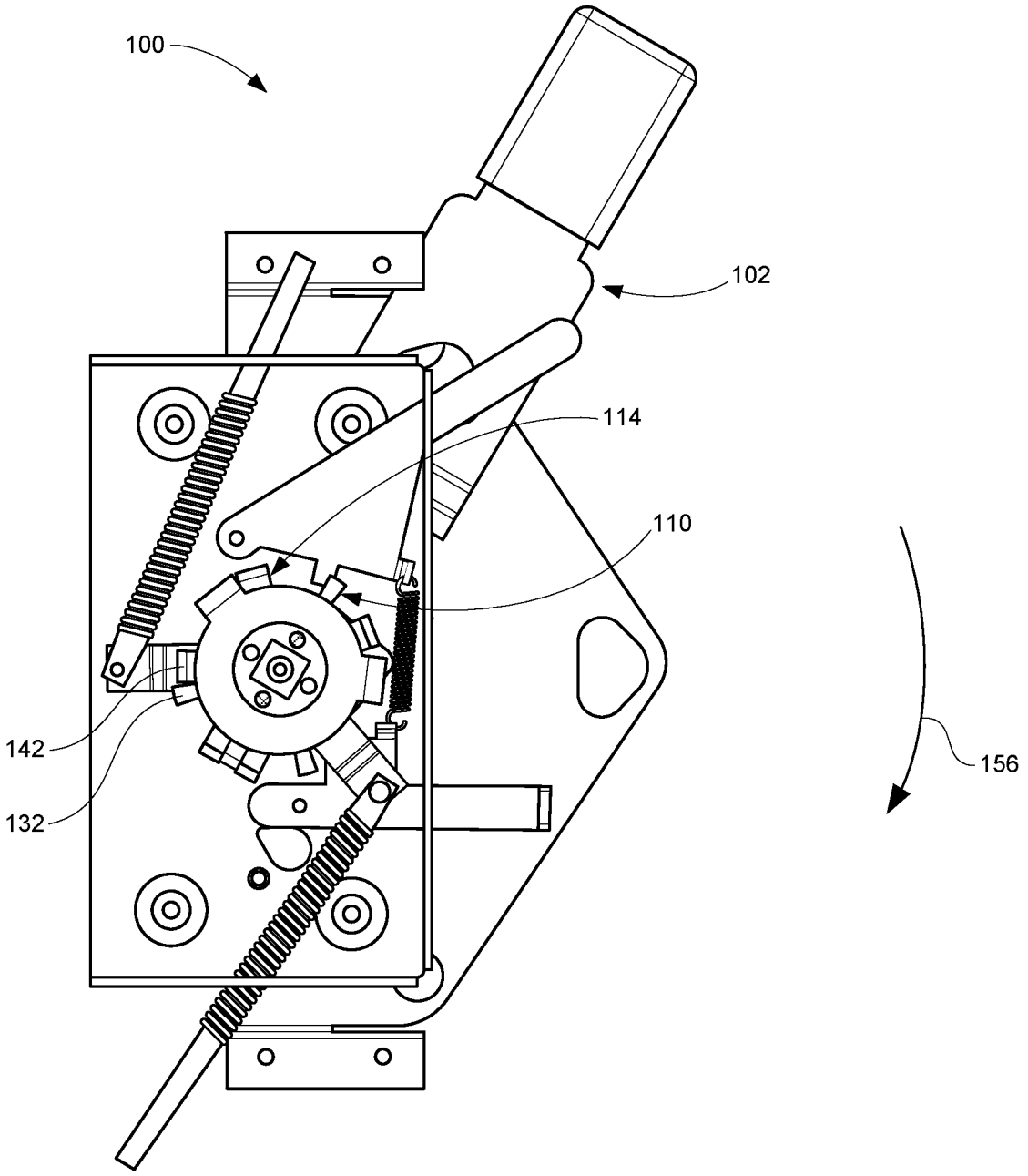
FIGS. 7A-7E are exemplary side elevational views illustrating an example of a switching mechanism wherein a switch is transitioning from a second closed position to an open position.
Figure 7B:
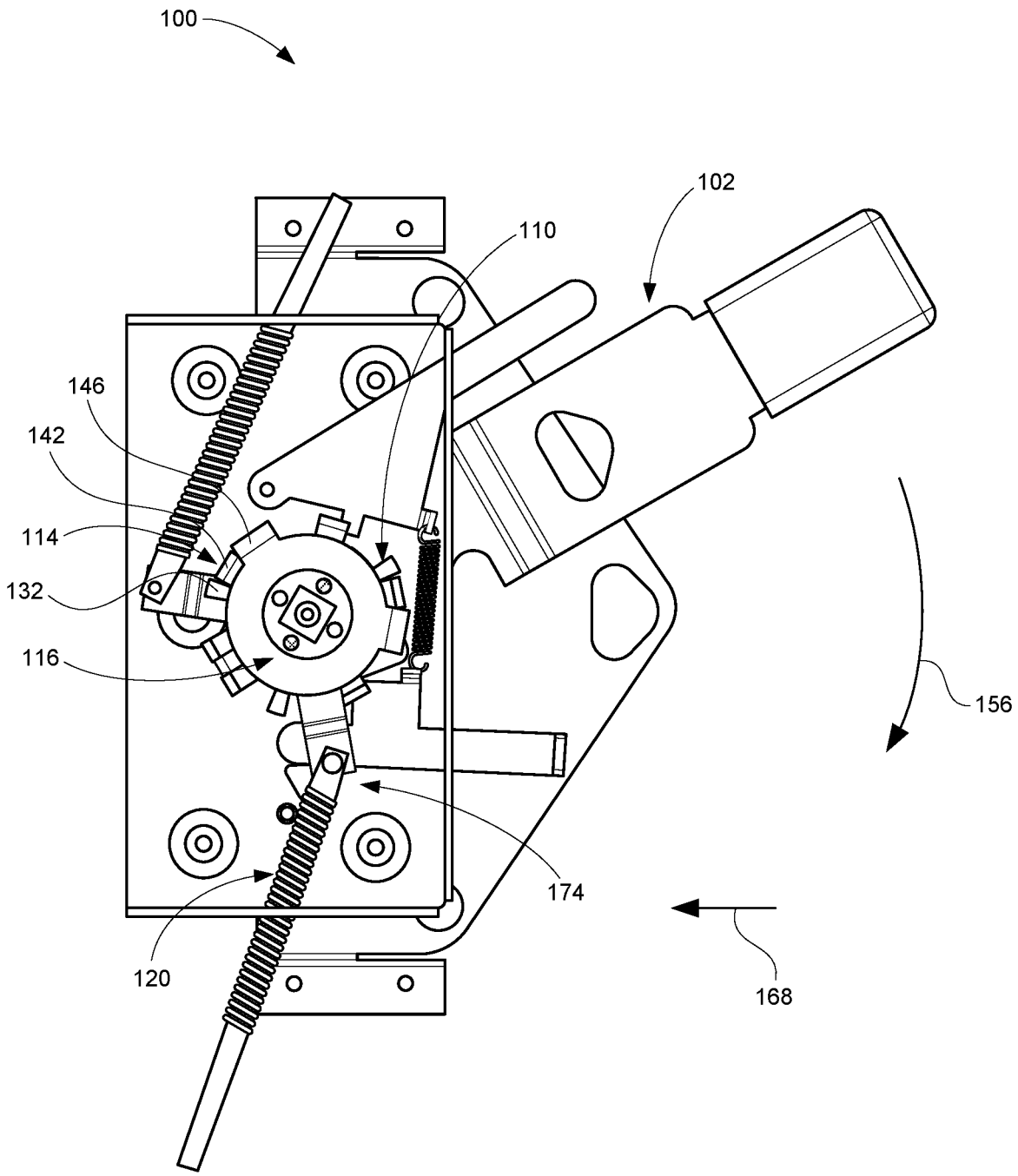

Movement of the actuator 102 from the second on position 106B to the off position 104 to thereby move the switch 10 from the second closed position 16 shown in FIG. 1C to the open position 14 shown in FIG. 1A will now be described with reference to FIGS. 6D-7E. To move the switch 10 from the second closed position 16 to the open position 14, the actuator 102 is rotated relative to the mounting plate 160 in the direction of the arrow 156 (i.e., clockwise). As the actuator 102 is rotated in the direction 156 from the second on position 106B shown in FIG. 6D to the position shown in FIG. 7A, the actuator disc 110 is rotated in the direction 156 along with the actuator 102 such that the flange 132 of the actuator disc 110 is moved into engagement in physical contact with the flange 142 of the bias disc 114. As the actuator 102 is rotated further in the direction 156 from the position shown in FIG. 7A to the position shown in FIG. 7B, the engagement between the flange 132 of the actuator disc 110 and the flange 142 of the bias disc 114 rotates the bias disc 114 in the direction 156 to the position shown in FIG. 7B, wherein the flange 142 of the bias disc 114 is engaged in physical contact with the flange 146 of the switch disc 116. As is also shown in FIG. 7B, the rotation of the actuator 102 in the direction 156 has moved the end portion 174 of the biasing mechanism 120 in the direction of the arrow 168 toward the overcenter position 172 (shown in FIG. 7D) of the biasing mechanism 120.

Figure 7C:
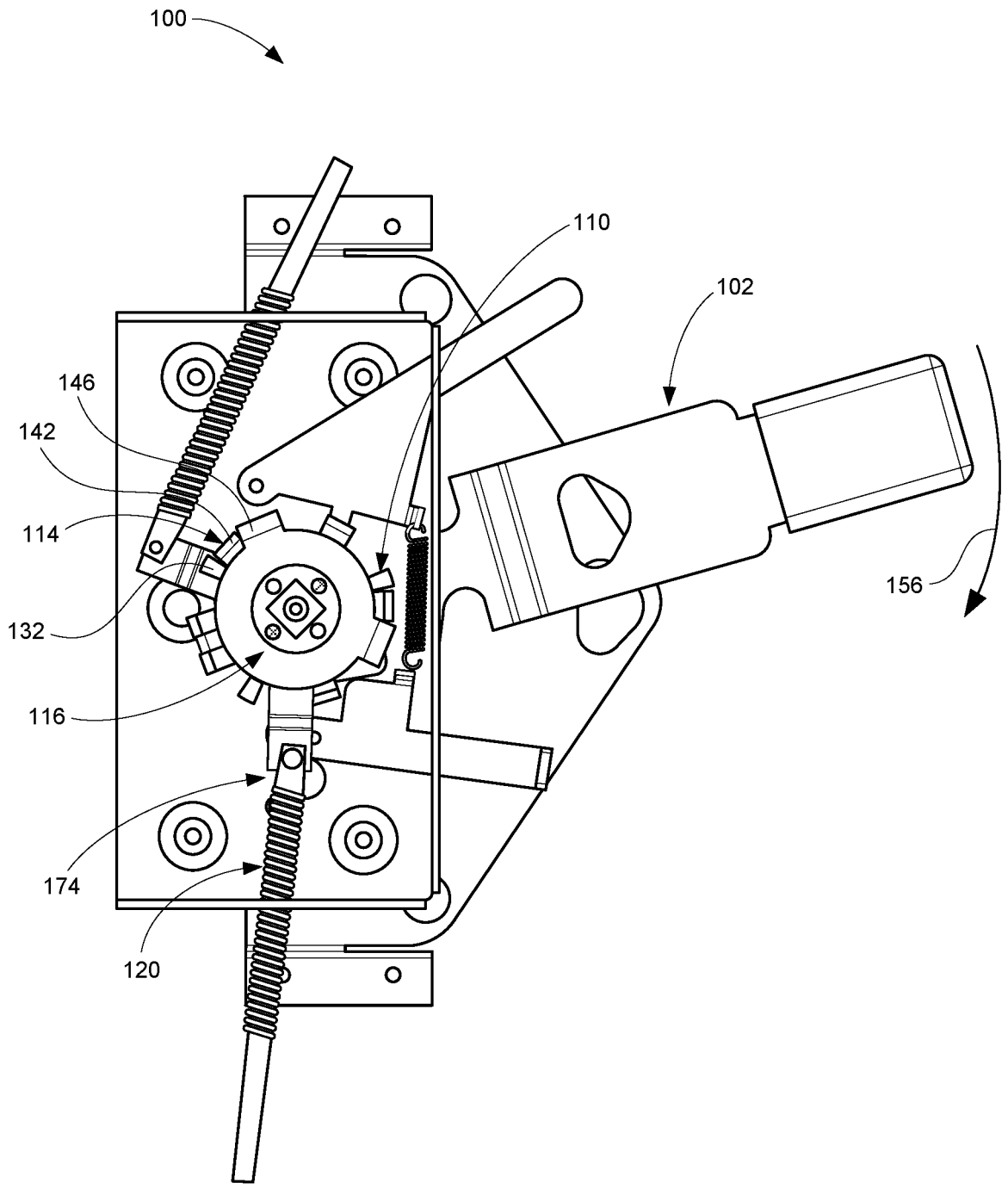

Continued rotation of the actuator 102 in the direction 156 advances the actuator disc 110, the bias disc 114, and the switch disc 116 in the direction 156 to the positions shown in FIG. 7C. Moreover, the continued rotation of the actuator 102 in the direction 156 shown between FIGS. 7B and 7C moves the end portion 174 of the biasing mechanism 120 further toward to the overcenter position 172 shown in FIG. 7D. In the position of the switching mechanism 100 shown in FIG. 7C, the end portion 174 of the biasing mechanism 120 is at an approximately centered position. As can be seen in FIG. 7C, the flange 132 of the actuator disc 110 remains engaged with the flange 142 of the bias disc 114, and the flange 142 of the bias disc 114 remains engaged with the flange 146 of the switch disc 116 in the position of the switching mechanism 100 shown in FIG. 7C.

Figure 7D:
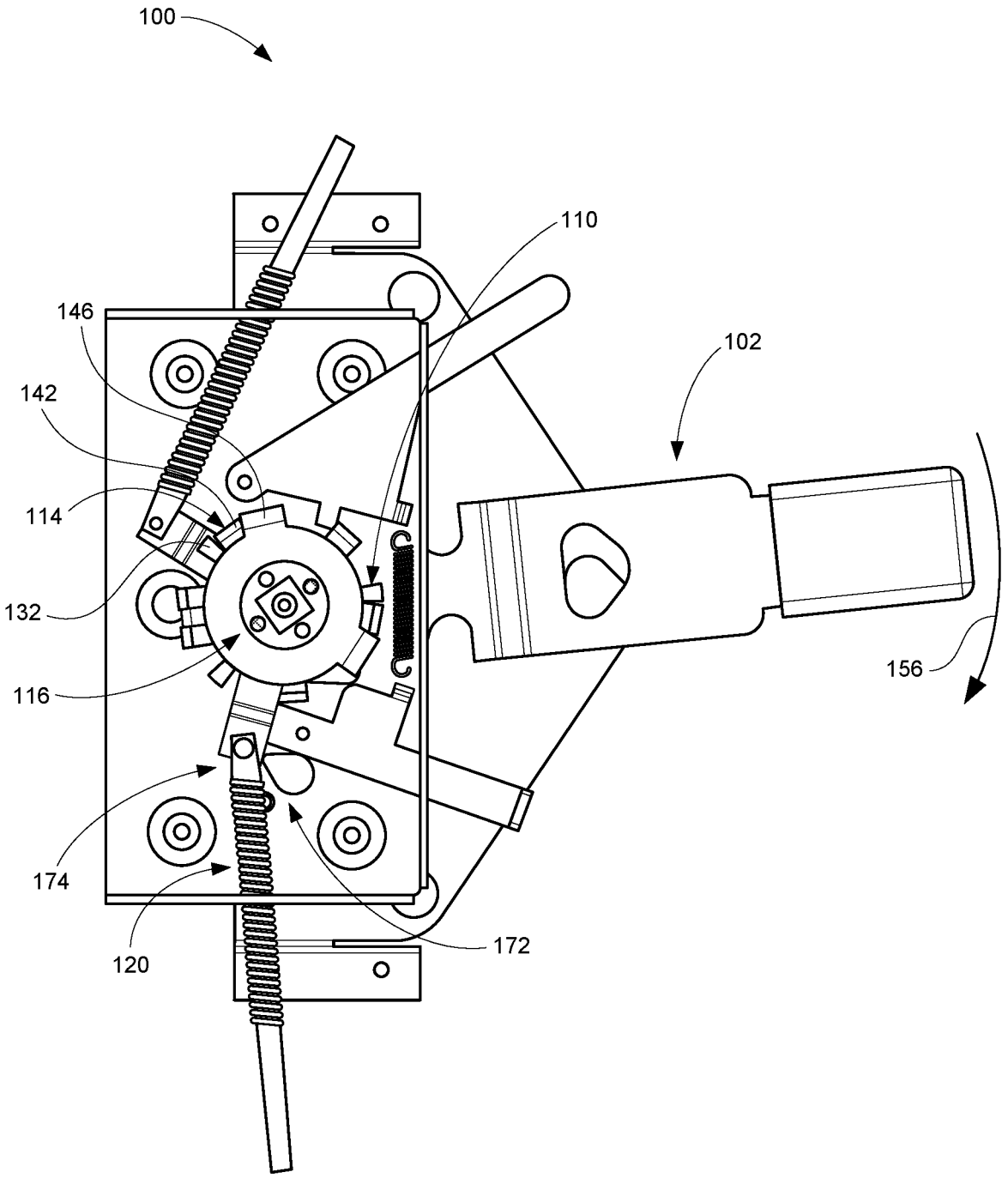
Figure 7E:
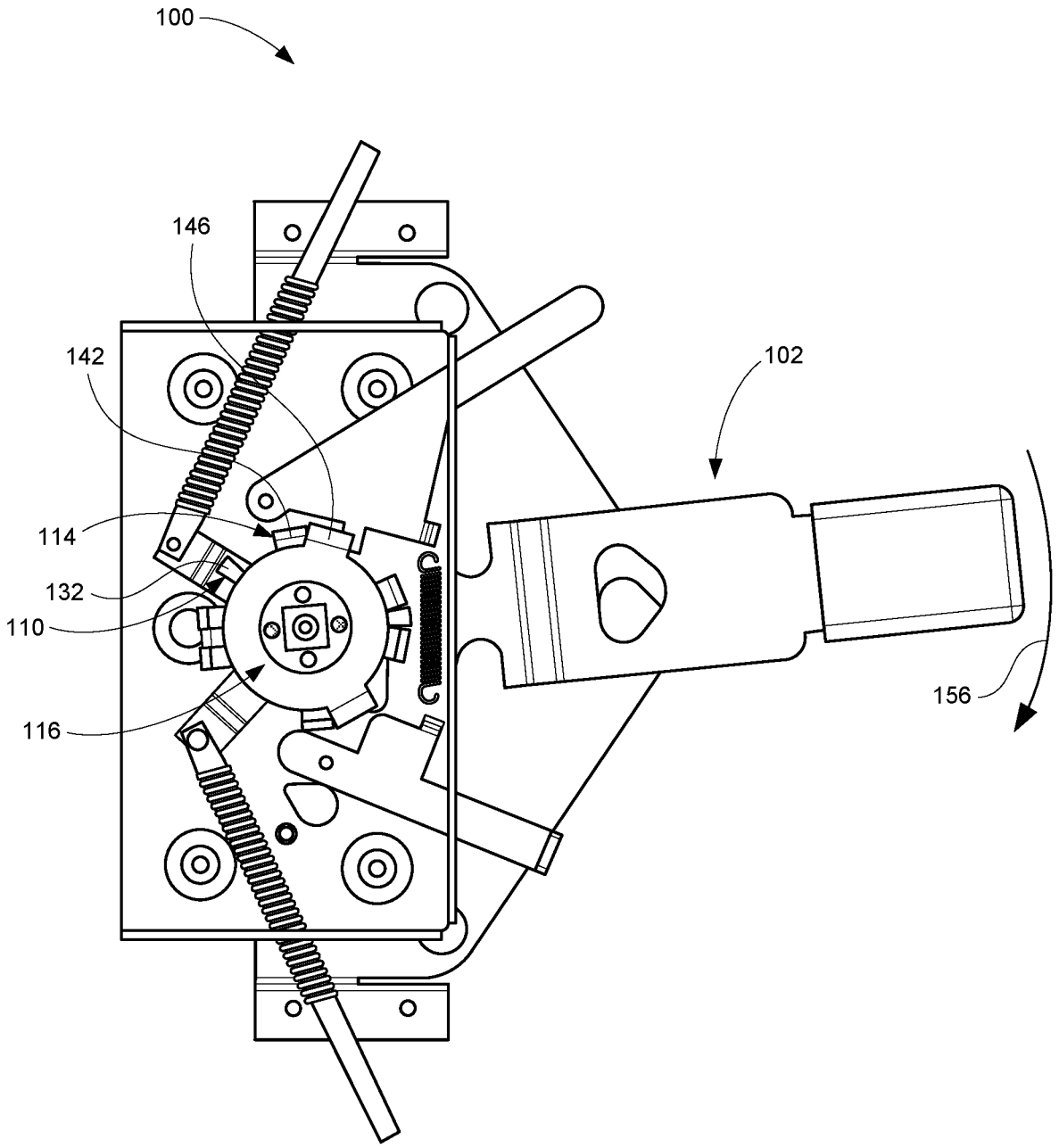
Figure 8:
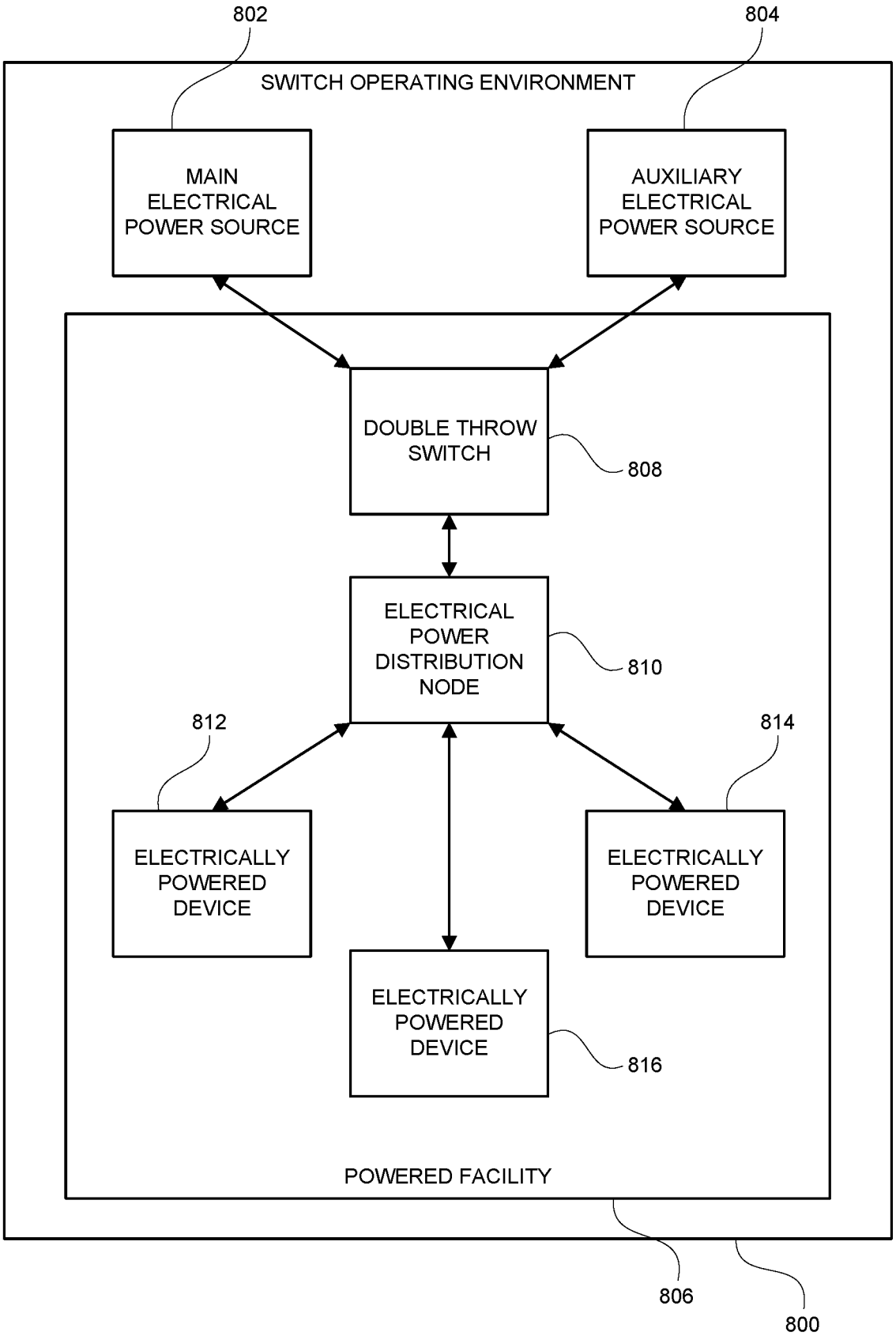
FIG. 8 is an exemplary block diagram illustrating a switch operating environment implementing a double throw switching mechanism and switch assembly.

As shown in FIG. 7D, further continued rotation of the actuator 102 in the direction 156 moves the end portion 174 of the biasing mechanism 120 to the overcenter position 172 wherein the bias of the biasing mechanism 120 acts to further rotate the bias disc 114 in the direction 156. In the position of the switching mechanism 100 shown in FIG. 7D, the flange 132 of the actuator disc 110 remains engaged with the flange 142 of the bias disc 114. But, at this position in the movement of the switching mechanism 100, the bias exerted on the bias disc 114 by the overcenter position 172 of the biasing mechanism 120 drives further rotation of the bias disc 114 in the direction 156 instead of the actuator 102. As the biasing mechanism 120 rotates the bias disc 114 further in the direction 156 from the position shown in FIG. 7D to the position shown in FIG. 7E and ultimately to the position of FIG. 4A, the engagement between the flange 142 of the bias disc 114 and the flange 146 of the switch disc 116 rotates the switch disc 116 in the direction 156 from the position shown in FIG. 7D to the position in FIG. 7E and ultimately to the position shown in FIG. 4A. As can be seen in FIG. 7E, the flange 132 of the actuator disc 110 separates from the flange 142 of the bias disc 114 as the biasing mechanism 120 rotates the bias disc 114 (and thereby the switch disc 116) from the position of the switching mechanism 100 shown in FIG. 7D to the position shown in FIG. 7E, even as the actuator 102 (and thereby the actuator disc 110) continues to rotate in the direction 156 to the open position 104 of FIG. 4A.

The position of the switch disc 116 shown in FIG. 4A corresponds to the open position 14 of the switch 10. Accordingly, rotation of the actuator 102 from the second on position 106B shown in FIG. 6D to the off position 104 shown in FIG. 4A thereby moves the switch 10 from the second closed position 16 shown in FIG. 1C to the open position 14 shown in FIG. 1A.

The switching mechanism 100 optionally includes one or more interlock devices. In the exemplary embodiment, the switching mechanism 100 includes an interlock device 180 and an interlock device 182. The interlock device 180 is operatively connected to the actuator 102 such that the interlock device 180 is configured to prevent the actuator 102 from being rotated from the off position 104 to the on positions 106A (shown in FIG. 4E) and 106B (shown in FIG. 6D) when a door (not shown) of an enclosure (not shown) that holds the switching mechanism 100 is open. More specifically, the interlock device 180 works in conjunction with the timing disc assembly 108 to prevent movement away from the open off position 104 (and thereby the open position 14 of the switch shown in FIG. 1A) when the door is open. The interlock device 182 is operatively connected to the actuator 102 to prevent the door from being opened when the actuator 102 is in the first on position 106A or the second on position 106B. More specifically, the interlock device 182 engages the door of the enclosure when the actuator 102 is in the first closed position 106A and when the actuator 102 is in the second closed position 106B such that the door cannot open while electrical current is flowing through the switch 10.

Although shown and described herein as including the lever 150 and handle 152 for manually operating the actuator 102 (i.e., manually moving the actuator 102 between the off position 104 and the on positions 106A and 106B), additionally or alternatively the switching mechanism 100 can be automatically moved between the off position 104 and the on positions 106A and 106B, for example using any suitable type of actuator, such as, but not limited to, an electro-mechanical device, an electric motor, a linear actuator (e.g., a ball screw, a lead screw, a rotary screw, another screw-type actuator, a hydraulic linear actuator, a pneumatic linear actuator, a solenoid, a servo, another type of linear actuator, etc.), a hydraulic actuator (e.g., a hydraulic pump system, etc.), a pneumatic actuator, a servo, and/or the like. In some examples, an automatically operated actuator 102 is controlled by another entity, such as, but not limited to, push-button controls, a computing device providing fully or partially automated control of the switching mechanism 100, remote triggers, radio controls, and/or the like. Some examples include a manually-operated actuator in addition to an automatically operated actuator for use when the automatic actuator malfunctions or is otherwise unavailable. Moreover, the manually operated actuator 102 is not limited to the lever 150 and handle 152 shown and described herein. Rather, other manually operated actuator configurations, arrangements, and/or the like can be provided in addition or alternatively to the lever 150 and/or handle 152.

Although shown herein as including two biasing mechanisms 118 and 120 for moving the switch 10 between the open position 14 and the first and second closed positions 12 and 16, respectively, the switching mechanism 100 can include any number of the biasing mechanisms that enables the switching mechanism to function as described and/or illustrated herein. For example, in some other embodiments the switching mechanism includes only one biasing mechanism for moving the switch 10 between the open position 14 and the first and second closed positions 12 and 16, respectively.

In the exemplary embodiment, each of the biasing mechanisms 118 and 120 is shown as including a helical spring. But, the biasing mechanisms 118 and 120 are not limited to including helical springs. Rather, each biasing mechanism 118 and 120 can include any other type of spring and/or other type of biasing mechanism that enables the switching mechanism 100 to function as described and/or illustrated herein, such as, but not limited to, a flat spring, a machined spring, a serpentine spring, a torsion spring, a tension spring, a constant spring, a variable spring, a variable stiffness spring, a leaf spring, a cantilever spring, a volute spring, a v-spring, and/or the like.

Unless explicitly stated otherwise herein, nothing in the disclosure herein is either intended to, or should be interpreted to, limit the number of poles usable with the disclosed switch mechanism, switch assembly, switch, etc.

At least a portion of the functionality of the various elements in FIG. 1A, FIG. 1B, FIG. 1C, FIG. 2, FIG. 3, FIG. 4A, FIG. 4B, FIG. 4C, FIG. 4D, FIG. 4E, FIG. 5A, FIG. 5B, FIG. 5C, FIG. 5D, FIG. 5E, FIG. 6A, FIG. 6B, FIG. 6C, FIG. 6D, FIG. 7A, FIG. 7B, FIG. 7C, FIG. 7D, FIG. 7E, and FIG. 8 (herein, the "figure set") may be performed by other elements in the figure set, or an entity (e.g., a computer controlled electro-mechanical device serving as the actuator) not shown in the figure set.

While the aspects of the disclosure have been described in terms of various examples with their associated operations, a person skilled in the art would appreciate that a combination of operations from any number of different examples is also within scope of the aspects of the disclosure.

Exemplary Operating Environment

The present disclosure is operable in a variety of environments for a variety of applications. For illustrative purposes only, and with no intent to limit the possible operating environments in which examples of the disclosure operate, the following exemplary operating environment is presented. The present disclosure is operable within a switch operating environment according to an embodiment as a functional bock diagram 800 in FIG. 8. The switch operating environment 800 includes any real-world location where electricity distribution is practicable. Such locations include but are not limited to any location with access to at least one electrical power source (including but not limited to, e.g., a municipal power grid, a solar farm, a wind farm, etc.).

The exemplary switch operating environment 800 comprises a main electrical power source 802 (e.g.: a feed from an electricity source configured to provide a constant, always-available source of electricity, including but not limited to: a municipal electrical grid, solar farm, wind farm, etc.) and an auxiliary electrical power source 804 (e.g.: a feed from a secondary and/or backup electricity source, including but not limited to one or more generators, configured for use when the main electrical power source 802 is unavailable). The switch operating environment 800 further comprises a powered facility 806. Examples of the powered facility 806 include but are not limited to: factories and manufacturing plants; hospitals; apartment buildings; houses; and buildings containing commercial office space.

The powered facility 806 comprises a double throw switch 808. In some examples, the double throw switch 808 is the switch assembly 200 containing the switch 10 and the switching mechanism 100 from FIG. 1A, FIG. 1B, FIG. 1C, and FIG. 2. The double throw switch 808 is conductively connected to both the main electrical power source 802 and the auxiliary electrical power source 804, such that the double throw switch 808 is operable to switch between the main electrical power source 802 and the auxiliary electrical power source 804 as described elsewhere herein.

If the double throw switch 808 is in the open position, the double throw switch 808 will not conduct electricity from either the main electrical power source 802 or the auxiliary electrical power source 804 into the powered facility 806. If the double throw switch 808 is in the first closed position, the double throw switch 808 will conduct electricity from the main electrical power source 802 into the powered facility 806. If the double throw switch 808 is in the second closed position, the double throw switch 808 will conduct electricity from the auxiliary electrical power source 804 into the powered facility 806. Thus, the double throw switch 808 is usable not only to switch between two available power sources, but also, with minimal effort, to completely cut the supply of electricity to the powered facility 806 whenever necessary.

The powered facility 806 includes any number of electrically powered devices. In the exemplary embodiment, three electrically powered devices 812, 814, and 816 are provided. In embodiments wherein the powered facility 806 includes more than one electrically powered device 812, 814, and/or 816, the powered facility 806 optionally includes an electrical power distribution node 810. Each of the electrically powered devices 812, 814, and 816 can be any type of electrically powered device for any intended application, such as, but are not limited to, manufacturing equipment, medical equipment, commercial office equipment (e.g., computers and computer peripherals, telephones and other communications devices, etc.), utilities within the powered facility 806 (e.g., light fixtures; heating, ventilation, and air conditioning ("HVAC") systems, electrically powered plumbing systems, etc.), and/or the like. Some examples of the electrical power distribution node 810 include but are not limited to, surge protectors, uninterrupted power supplies, and/or any other device configured to distribute electricity from a single circuit to multiple powered devices. In examples including the electrical power distribution node 810, any number of devices may be connected to the electrical power distribution node 810, such as the electrically powered device 812, the electrically powered device 814, and/or the electrically powered device 816.

In some examples of the switch operating environment 800, the double throw switch 808 is configured to draw electrical power from a single electrical power source and conduct electricity into one of two loads, as determined by the position of the double throw switch 808. In such examples, each load is either a single powered device or a group of powered devices. Such examples are an inversion of the example presented in FIG. 8 and discussed above. This demonstrates the flexibility of the double throw switch 808.

The examples of a double throw switch disclosed herein, including examples of switches, switching mechanisms, and switch assemblies, operate an electrical switch. Movement of an actuator transfers force to a timing disc assembly, which closes or opens either a first set of electrical contacts or a second set of electrical contacts depending on the direction of the movement of the switch and the original position of the switch. The actuator is also moveable into a position that leaves both the first set of electrical contacts and the second set of electrical contacts open, such that no electricity flows through either the first set of electrical contacts or the second set of electrical contacts. The disclosure allows a single switching mechanism to actuate the double throw switch from the off position to either the first closed circuit position or the second closed circuit position.

As described herein, the present disclosure provides systems for constructing and deploying a double throw switch comprising a single disc-based mechanism configured to operate a double throw switch with a single actuator. Examples of the disclosure do not require any complex linkage apparatuses and/or slider plates connected to a common actuator, use fewer components than contemporary switches, and are mechanically simpler than contemporary switches. Examples of the disclosure are therefore less expensive to produce, repair, and maintain.

While various spatial and directional terms, including but not limited to top, bottom, lower, mid, lateral, horizontal, vertical, front and the like may be used to describe the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

The order of execution or performance of the operations in examples of the disclosure illustrated and described herein is not essential, unless otherwise specified. That is, the operations may be performed in any order, unless otherwise specified, and examples of the disclosure may include additional or fewer operations than those disclosed herein. For example, it is contemplated that executing or performing a particular operation before, contemporaneously with, or after another operation is within the scope of aspects of the disclosure.

When introducing elements of aspects of the disclosure or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of" The phrase "one or more of the following: A, B, and C" means "at least one of A and/or at least one of B and/or at least one of C." Further, the limitations of the following claims are not written in means-plus-function format and are not intended to be interpreted based on 35 U.S.C. § 112(f), unless and until such claim limitations expressly use the phrase "means for" followed by a statement of function void of further structure.

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

Clauses

The following clauses describe further aspects:

Clause Set A:

A1. A switching mechanism for actuating a switch, the switching mechanism comprising:

an actuator rotatable between an off position and an on position; and a timing disc assembly comprising an actuator disc, a bias disc, and a switch disc arranged in a stack such that the actuator disc, the bias disc, and the switch disc overlay each other, the actuator disc being rotatably connected to the actuator such that the actuator disc is configured to rotate with the actuator, the bias disc being connected to at least one biasing mechanism, the switch disc being connected to the switch, the actuator disc being configured to engage the bias disc such that the actuator disc is configured to rotate the bias disc to an overcenter position of the at least one biasing mechanism, wherein the overcenter position of the at least one biasing mechanism is configured to rotate the bias disc such that engagement between the bias disc and the switch disc is configured to rotate the switch disc between a closed position and an open position of the switch.

A2. The switching mechanism of any preceding clause, wherein the actuator disc comprises a first actuator flange configured to engage a first bias flange of the bias disc that is configured to engage a switch flange of the switch disc to rotate the switch disc from the open position of the switch to the closed position of the switch, the actuator disc comprising a second actuator flange configured to engage a second bias flange of the bias disc that is configured to engage the switch flange to rotate the switch disc from the closed position to the open position of the switch.

A3. The switching mechanism of any preceding clause, wherein the bias disc is a first bias disc and the closed position of the switch is a first closed position, the timing disc assembly further comprising a second bias disc arranged within the stack and connected to the at least one biasing mechanism, the actuator disc being configured to engage the second bias disc such that the actuator disc is configured to rotate the second bias disc to the overcenter position of the at least one biasing mechanism, the overcenter position of the at least one biasing mechanism being configured to rotate the second bias disc such that engagement between the second bias disc and the switch disc is configured to rotate the switch disc between the open position and a second closed position of the switch.

A4. The switching mechanism of any preceding clause, wherein the bias disc is a first bias disc, the at least one biasing mechanism is a first biasing mechanism, and the closed position of the switch is a first closed position, the timing disc assembly further comprising a second bias disc arranged within the stack and connected to a second biasing mechanism, the actuator disc being configured to engage the second bias disc such that the actuator disc is configured to rotate the second bias disc to an overcenter position of the second biasing mechanism, the overcenter position of the second biasing mechanism being configured to rotate the second bias disc such that engagement between the second bias disc and the switch disc is configured to rotate the switch disc between the open position and a second closed position of the switch.

A5. The switching mechanism of any preceding clause, wherein the actuator disc is arranged within the stack between the bias disc and the switch disc.

A6. The switching mechanism of any preceding clause, further comprising at least one interlock device operatively connected to the actuator such that the at least one interlock device is configured to at least one of prevent the actuator from being rotated from the off position to the on position when a door of an enclosure is open or prevent the door from being opened when the actuator is in the on position.

A7. The switching mechanism of any preceding clause, wherein the actuator comprises a lever having a handle.

A8. The switching mechanism of any preceding clause, wherein the at least one biasing mechanism comprises a helical spring.

Clause Set B:

B1. A switch assembly comprising:

a switch having an open position and a closed position; and a switching mechanism operatively connected to the switch for actuating the switch between the open position and the closed position, the switching mechanism comprising:

an actuator rotatable between an off position wherein the switch is in the open position and an on position wherein the switch is in the closed position; and a timing disc assembly comprising an actuator disc, a bias disc, and a switch disc arranged in a stack such that the actuator disc, the bias disc, and the switch disc overlay each other, the actuator disc being rotatably connected to the actuator such that the actuator disc is configured to rotate with the actuator, the bias disc being connected to at least one biasing mechanism, the switch disc being connected to the switch, the actuator disc being configured to engage the bias disc such that the actuator disc is configured to rotate the bias disc to an overcenter position of the at least one biasing mechanism, wherein the overcenter position of the at least one biasing mechanism is configured to rotate the bias disc such that engagement between the bias disc and the switch disc is configured to rotate the switch disc between the open position and the closed position of the switch.

B2. The switch assembly of any preceding clause, wherein the actuator disc comprises a first actuator flange configured to engage a first bias flange of the bias disc that is configured to engage a switch flange of the switch disc to rotate the switch disc from the open position of the switch to the closed position of the switch, the actuator disc comprising a second actuator flange configured to engage a second bias flange of the bias disc that is configured to engage the switch flange to rotate the switch disc from the closed to the open position of the switch.

B3. The switch assembly of any preceding clause, wherein the bias disc is a first bias disc and the closed position of the switch is a first closed position, the timing disc assembly further comprising a second bias disc arranged within the stack and connected to the at least one biasing mechanism, the actuator disc being configured to engage the second bias disc such that the actuator disc is configured to rotate the second bias disc to an overcenter position of the at least one biasing mechanism, wherein the overcenter position of the at least one biasing mechanism is configured to rotate the second bias disc such that engagement between the second bias disc and the switch disc is configured to rotate the switch disc between the open position and a second closed position of the switch.

B4. The switch assembly of any preceding clause, wherein the bias disc is a first bias disc, the at least one biasing mechanism is a first biasing mechanism, and the closed position of the switch is a first closed position, the timing disc assembly further comprising a second bias disc arranged within the stack and connected to a second biasing mechanism, the actuator disc being configured to engage the second bias disc such that the actuator disc is configured to rotate the second bias disc to an overcenter position of the second biasing mechanism, the overcenter position of the second biasing mechanism being configured to rotate the second bias disc such that engagement between the second bias disc and the switch disc is configured to rotate the switch disc between the open position and a second closed position of the switch.

B5. The switch assembly of any preceding clause, wherein the actuator disc is arranged within the stack between the bias disc and the switch disc.

B6. The switch assembly of any preceding clause, wherein the switching mechanism comprises at least one interlock device operatively connected to the actuator such that the at least one interlock device is configured to at least one of prevent the actuator from being rotated from the off position to the on position when a door of an enclosure is open or prevent the door from being opened when the actuator is in the on position.

Clause Set C:

C1. A switch assembly comprising:

a switch comprising a first set of electrical contacts and a second set of electrical contacts, the switch having an off position wherein the first set of electrical contacts is open and the second set of electrical contacts is open, the switch having a first closed position wherein the first set of electrical contacts is closed and the second set of electrical contacts is open, the switch having a second closed position wherein the first set of electrical contacts is open and the second set of electrical contacts is closed; and a switching mechanism operatively connected to the switch for actuating the switch between the open position and the first closed position and the second closed position, the switching mechanism comprising an actuator and a timing disc assembly, wherein the timing disc assembly comprises an actuator disc and a switch disc arranged in a stack such that the actuator disc and the switch disc overlay each other, the actuator disc being rotatably connected to the actuator such that the actuator disc is configured to rotate with the actuator, the switch disc being connected to the switch, the actuator disc being configured to rotate the switch disc such that the switch disc moves the switch between the open position and the first closed position and the second closed position of the switch.

C2. The switch assembly of any preceding clause, wherein the timing disc assembly further comprises first and second bias discs arranged within the stack, the first and second bias discs being connected to at least one biasing mechanism, the actuator disc being configured to engage the first bias disc such that the actuator disc is configured to rotate the first bias disc to an overcenter position of the at least one biasing mechanism, the overcenter position of the at least one biasing mechanism being configured to rotate the first bias disc such that engagement between the first bias disc and the switch disc is configured to rotate the switch disc between the open position and the first closed position of the switch, the actuator disc being configured to engage the second bias disc such that the actuator disc is configured to rotate the second bias disc to an overcenter position of the at least one biasing mechanism, the overcenter position of the at least one biasing mechanism being configured to rotate the second bias disc such that engagement between the second bias disc and the switch disc is configured to rotate the switch disc between the open position and the second closed position of the switch.

C3. The switch assembly of any preceding clause, wherein the timing disc assembly further comprises first and second bias discs arranged within the stack, the first and second bias discs being connected to first and second biasing mechanisms, respectively, the actuator disc being configured to engage the first bias disc such that the actuator disc is configured to rotate the first bias disc to an overcenter position of the first biasing mechanism, the overcenter position of the first biasing mechanism being configured to rotate the first bias disc such that engagement between the first bias disc and the switch disc is configured to rotate the switch disc between the open position and the first closed position of the switch, the actuator disc being configured to engage the second bias disc such that the actuator disc is configured to rotate the second bias disc to an overcenter position of the second biasing mechanism, the overcenter position of the second biasing mechanism being configured to rotate the second bias disc such that engagement between the second bias disc and the switch disc is configured to rotate the switch disc between the open position and the second closed position of the switch.

C4. The switch assembly of any preceding clause, wherein the switching mechanism comprises at least one interlock device operatively connected to the actuator such that the at least one interlock device is configured to at least one of prevent the actuator from being rotated when a door of an enclosure is open or prevent the door from being opened when the switch is in the first closed position or the second closed position.

C5. The switch assembly of any preceding clause, wherein the actuator comprises at least one of a lever or an electro-mechanical device.

What is claimed is:

1. A switching mechanism for actuating a switch, the switching mechanism comprising:

an actuator rotatable between an off position and an on position; and a timing disc assembly comprising an actuator disc, a bias disc, and a switch disc arranged in a stack such that the actuator disc, the bias disc, and the switch disc overlay each other, the actuator disc being rotatably connected to the actuator such that the actuator disc is configured to rotate with the actuator, the actuator disc comprising a first actuator flange and a second actuator flange, the bias disc being connected to at least one biasing mechanism, the bias disc comprising a first bias flange and a second bias flange, the switch disc being connected to the switch, the switch disc comprising a switch flange, the first actuator flange of the actuator disc being configured to engage the first bias flange of the bias disc such that the actuator disc is configured to rotate the bias disc to an overcenter position of the at least one biasing mechanism, wherein the overcenter position of the at least one biasing mechanism is configured to rotate the bias disc such that engagement between the first bias flange of the bias disc and the switch flange of the switch disc is configured to rotate the switch disc from an open position of the switch to a closed position of the switch, the second actuator flange of the actuator disc being configured to engage the second bias flange of the bias disc such that the actuator disc is configured to rotate the bias disc to the overcenter position of the at least one biasing mechanism, wherein the overcenter position of the at least one biasing mechanism is configured to rotate the bias disc such that engagement between the second bias flange of the bias disc and the switch flange of the switch disc is configured to rotate the switch disc from the closed position to the open position of the switch.

2. The switching mechanism of claim 1, wherein the bias disc is a first bias disc and the closed position of the switch is a first closed position, the timing disc assembly further comprising a second bias disc arranged within the stack and connected to the at least one biasing mechanism, the actuator disc being configured to engage the second bias disc such that the actuator disc is configured to rotate the second bias disc to the overcenter position of the at least one biasing mechanism, the overcenter position of the at least one biasing mechanism being configured to rotate the second bias disc such that engagement between the second bias disc and the switch disc is configured to rotate the switch disc between the open position and a second closed position of the switch.

3. The switching mechanism of claim 1, wherein the bias disc is a first bias disc, the at least one biasing mechanism is a first biasing mechanism, and the closed position of the switch is a first closed position, the timing disc assembly further comprising a second bias disc arranged within the stack and connected to a second biasing mechanism, the actuator disc being configured to engage the second bias disc such that the actuator disc is configured to rotate the second bias disc to an overcenter position of the second biasing mechanism, the overcenter position of the second biasing mechanism being configured to rotate the second bias disc such that engagement between the second bias disc and the switch disc is configured to rotate the switch disc between the open position and a second closed position of the switch.

4. The switching mechanism of claim 1, wherein the actuator disc is arranged within the stack between the bias disc and the switch disc.

5. The switching mechanism of claim 1, further comprising at least one interlock device operatively connected to the actuator such that the at least one interlock device is configured to at least one of prevent the actuator from being rotated from the off position to the on position when a door of an enclosure is open or prevent the door from being opened when the actuator is in the on position.

6. The switching mechanism of claim 1, wherein the actuator comprises a lever having a handle.

7. The switching mechanism of claim 1, wherein the at least one biasing mechanism comprises a helical spring.

8. A switch assembly comprising:

a switch having an open position and a closed position; and a switching mechanism operatively connected to the switch for actuating the switch between the open position and the closed position, the switching mechanism comprising:

an actuator rotatable between an off position wherein the switch is in the open position and an on position wherein the switch is in the closed position; and a timing disc assembly comprising an actuator disc, a bias disc, and a switch disc arranged in a stack such that the actuator disc, the bias disc, and the switch disc overlay each other, the actuator disc being rotatably connected to the actuator such that the actuator disc is configured to rotate with the actuator, the actuator disc comprising a first actuator flange and a second actuator flange, the bias disc being connected to at least one biasing mechanism, the bias disc comprising a first bias flange and a second bias flange, the switch disc being connected to the switch, the switch disc comprising a switch flange, the first actuator flange of the actuator disc being configured to engage the first bias flange of the bias disc such that the actuator disc is configured to rotate the bias disc to an overcenter position of the at least one biasing mechanism, wherein the overcenter position of the at least one biasing mechanism is configured to rotate the bias disc such that engagement between the first bias flange of the bias disc and the switch flange of the switch disc is configured to rotate the switch disc from the open position to the closed position of the switch, the second actuator flange of the actuator disc being configured to engage the second bias flange of the bias disc such that the actuator disc is configured to rotate the bias disc to the overcenter position of the at least one biasing mechanism, wherein the overcenter position of the at least one biasing mechanism is configured to rotate the bias disc such that engagement between the second bias flange of the bias disc and the switch flange of the switch disc is configured to rotate the switch disc from the closed position to the open position of the switch.

9. The switch assembly of claim 8, wherein the bias disc is a first bias disc and the closed position of the switch is a first closed position, the timing disc assembly further comprising a second bias disc arranged within the stack and connected to the at least one biasing mechanism, the actuator disc being configured to engage the second bias disc such that the actuator disc is configured to rotate the second bias disc to an overcenter position of the at least one biasing mechanism, wherein the overcenter position of the at least one biasing mechanism is configured to rotate the second bias disc such that engagement between the second bias disc and the switch disc is configured to rotate the switch disc between the open position and a second closed position of the switch.

10. The switch assembly of claim 8, wherein the bias disc is a first bias disc, the at least one biasing mechanism is a first biasing mechanism, and the closed position of the switch is a first closed position, the timing disc assembly further comprising a second bias disc arranged within the stack and connected to a second biasing mechanism, the actuator disc being configured to engage the second bias disc such that the actuator disc is configured to rotate the second bias disc to an overcenter position of the second biasing mechanism, the overcenter position of the second biasing mechanism being configured to rotate the second bias disc such that engagement between the second bias disc and the switch disc is configured to rotate the switch disc between the open position and a second closed position of the switch.

11. The switch assembly of claim 8, wherein the actuator disc is arranged within the stack between the bias disc and the switch disc.

12. The switch assembly of claim 8, wherein the switching mechanism comprises at least one interlock device operatively connected to the actuator such that the at least one interlock device is configured to at least one of prevent the actuator from being rotated from the off position to the on position when a door of an enclosure is open or prevent the door from being opened when the actuator is in the on position.

13. The switch assembly of claim 8, wherein the actuator comprises a lever having a handle.

14. The switch assembly of claim 8, wherein the at least one biasing mechanism comprises a helical spring.

15. A switch assembly comprising:

a switch comprising a first set of electrical contacts and a second set of electrical contacts, the switch having an off position wherein the first set of electrical contacts is open and the second set of electrical contacts is open, the switch having a first closed position wherein the first set of electrical contacts is closed and the second set of electrical contacts is open, the switch having a second closed position wherein the first set of electrical contacts is open and the second set of electrical contacts is closed; and a switching mechanism operatively connected to the switch for actuating the switch between the off position and the first closed position and the second closed position, the switching mechanism comprising an actuator and a timing disc assembly, wherein the timing disc assembly comprises an actuator disc, a bias disc, and a switch disc arranged in a stack such that the actuator disc, the bias disc, and the switch disc overlay each other, the actuator disc being rotatably connected to the actuator such that the actuator disc is configured to rotate with the actuator, the actuator disc comprising a first actuator flange and a second actuator flange, the bias disc comprising a first bias flange and a second bias flange, the switch disc being connected to the switch, the switch disc comprising a switch flange, the actuator disc being configured to rotate the switch disc such that the switch disc moves the switch between the off position and the first closed position and the second closed position of the switch, the first actuator flange being configured to engage the first bias flange and the first bias flange is configured to engage the switch flange to rotate the switch disc from the off position to the first closed position of the switch, the second actuator flange being configured to engage the second bias flange and the second bias flange is configured to engage the switch flange to rotate the switch disc from the first closed position to the off position of the switch.

16. The switch assembly of claim 15, wherein the bias disc is a first bias disc and the timing disc assembly further comprises a second bias disc arranged within the stack, the first and second bias discs being connected to at least one biasing mechanism, the actuator disc being configured to engage the first bias disc such that the actuator disc is configured to rotate the first bias disc to an overcenter position of the at least one biasing mechanism, the overcenter position of the at least one biasing mechanism being configured to rotate the first bias disc such that engagement between the first bias disc and the switch disc is configured to rotate the switch disc between the off position and the first closed position of the switch, the actuator disc being configured to engage the second bias disc such that the actuator disc is configured to rotate the second bias disc to an overcenter position of the at least one biasing mechanism, the overcenter position of the at least one biasing mechanism being configured to rotate the second bias disc such that engagement between the second bias disc and the switch disc is configured to rotate the switch disc between the off position and the second closed position of the switch.

17. The switch assembly of claim 15, wherein the bias disc is a first bias disc and the timing disc assembly further comprises a second bias disc arranged within the stack, the first and second bias discs being connected to first and second biasing mechanisms, respectively, the actuator disc being configured to engage the first bias disc such that the actuator disc is configured to rotate the first bias disc to an overcenter position of the first biasing mechanism, the overcenter position of the first biasing mechanism being configured to rotate the first bias disc such that engagement between the first bias disc and the switch disc is configured to rotate the switch disc between the off position and the first closed position of the switch, the actuator disc being configured to engage the second bias disc such that the actuator disc is configured to rotate the second bias disc to an overcenter position of the second biasing mechanism, the overcenter position of the second biasing mechanism being configured to rotate the second bias disc such that engagement between the second bias disc and the switch disc is configured to rotate the switch disc between the off position and the second closed position of the switch.

18. The switch assembly of claim 15, wherein the switching mechanism comprises at least one interlock device operatively connected to the actuator such that the at least one interlock device is configured to at least one of prevent the actuator from being rotated when a door of an enclosure is open or prevent the door from being opened when the switch is in the first closed position or the second closed position.

19. The switch assembly of claim 15, wherein the actuator comprises a lever.

20. The switch assembly of claim 15, wherein the timing disc assembly further comprises at least one biasing mechanism.

* * * * *